United States Patent [19]

Nishijima et al.

[11] Patent Number: 4,916,050

[45] Date of Patent: Apr. 10, 1990

[54] SILVER HALIDE LIGHT-SENSITIVE PHOTOGRAPHIC MATERIAL

[75] Inventors: Toyoki Nishijima, Odawara; Kaoru Onodera, Sagamihara, both of Japan

[73] Assignee: Konica Corporation, Tokyo, Japan

[21] Appl. No.: 198,319

[22] Filed: May 25, 1988

[30] Foreign Application Priority Data

May 26, 1987 [JP] Japan ..... 65-130686
Jun. 3, 1987 [JP] Japan ..... 65-140416

[51] Int. Cl.[4] ..... G03C 1/38; G03C 7/26; G03C 7/34; G03C 7/38

[52] U.S. Cl. ..... 430/546; 430/551; 430/552; 430/553; 430/558; 430/631; 430/634; 430/635; 430/638

[58] Field of Search ..... 430/546, 634, 635, 637, 430/638, 552, 553, 556, 557, 558, 551, 631

[56] References Cited

U.S. PATENT DOCUMENTS

| | | | |
|---|---|---|---|
| 3,033,680 | 5/1962 | Milton et al. | 430/637 |
| 3,619,195 | 11/1971 | van Campen | 430/546 |
| 4,419,441 | 12/1983 | Nittel et al. | 430/377 |
| 4,537,857 | 8/1985 | Takada et al. | 430/549 |
| 4,795,696 | 1/1989 | Sasaki et al. | 430/512 |

FOREIGN PATENT DOCUMENTS

| | | |
|---|---|---|
| 0203465 | 12/1986 | European Pat. Off. . |
| 1439052 | 6/1976 | United Kingdom . |

*Primary Examiner*—Paul R. Michl
*Assistant Examiner*—Mark R. Buscher
*Attorney, Agent, or Firm*—Finnegan, Henderson, Farabow, Garrett and Dunner

[57] ABSTRACT

A silver halide light-sensitive photographic material comprising on a support photographic component layers containing a compound of Formula [I] and/or Formula [II]:

$$R_1OOC—R_2—COO\text{-}(R_3—OOC—R_2—COO)_n\text{-}R_4 \quad [I],$$

$$R_5O—R_6\text{-}(OOC—R_7—COO—R_6)_n\text{-}R_8 \quad [II]$$

wherein $R_1$ and $R_4$ are independently selected from the group consisting of an alkyl group, an alkenyl group, a cycloalkyl group, an aryl group and a heterocyclic group; $R_2$, $R_3$, $R_6$ and $R_7$ are divalent groups independently selected from the group consisting of an alkylene group, an alkenylene group, a cycloalkylene group and a group of any combination of these groups; $R_5$ and $R_6$ each is either an acyl group or a phosphonyl group; and n is an integer of from 1 to 20; is disclosed.

22 Claims, No Drawings

SILVER HALIDE LIGHT-SENSITIVE PHOTOGRAPHIC MATERIAL

FIELD OF THE INVENTION

The present invention relates to a silver halide light-sensitive photographic material, particularly to a silver halide light-sensitive photographic material in which the color formability, due image preservability and physical properties of the constituent layer have been improved, and more particularly to a silver halide light-sensitive color photographic material which is excellent in the color reproducibility.

BACKGROUND OF THE INVENTION

As one of those due image-forming methods using a silver halide color photographic light-sensitive material, there is a method for forming dyes by the reaction of photographic couplers with a color developing agent. As the photographic couplers for use in the ordinary color reproduction, magenta, yellow and cyan couplers are used, while as the color developing agent, an aromatic primary amine-type color developing agent is used; these couplers and the color developing agent, in their reaction, form azomethine dyes, indoaniline dyes and the like.

Normally, such couplers are incorporated separately into a plurality of light-sensitive layers to be coated. In addition to these light-sensitive layers, also into non-light-sensitive layers and a protective layer may be incorporated an anti-color-mixing agent, ultraviolet absorbing agent and the like for improving the image quality, dye image preservability and the like of a light-sensitive photographic material.

Thus, a silver halide light-sensitive photographic material contains a large number of such addivitives so as to adequately exhibit the characteristics of its silver halide. These additives include various compounds ranging from water-soluble compounds to water-insoluble compounds.

Of these compounds, those water-insoluble or less-soluble compounds; i.e., hydrophobic compounds, include dye image forming couplers, ultraviolet absorbing agents, anti-color-image-discoloration agents, anti-color-mixing agents, redox compounds, antifogging agents, and the like.

In order to incorporation such agents or compounds into a hydrophilic colloid layer, they are required to be finely dispersed in the oil-in-water-type or oil-protect-type form into the layer.

As methods for the above-mentioned dispersion of such hydrophobic compounds there are those methods wherein a hydrophobic compound is dispersed along with an organic solvent such as dibutyl phthalate, tricresyl phosphate or the like in the presence of a surface active agent as disclosed in U.S. Pat. Nos. 2,322,027, 2,835,579 and 3,748,141, Japanese Patent Examined Publication No. 24288/1979, and Japanese Patent Publication Open to Public Inspection (hereinafter referred to as Japanese Patent O.P.I. Publication) No. 114940/1981; and those methose wherein a hydrophobic compound is dispersed along with a high-molecular compound as described in U.S. Pat. Nos. 2,772,163 and 2,852,382, and Japanese Patent O.P.I. Publication No. 25133/1976.

These methods, however, have such problems that they cause the color formability and light resistance to be deteriorated; or they, even if harmless to the color formability and light resistance, if the dye image is preserved under a highly moist condition, cause the gloss of the dye image-bearing layer's surface to be deteriorated; and so forth.

SUMMARY OF THE INVENTION

It is therefore a first object of the present invention to provide a silver halide light-sensitive photographic material which has a high color formability and an excellent light resistance.

It is a second object of the present invention to provide a silver halide light-sensitive photographic material which is excellent in the color formability as well as in the light resistance with no deterioration in the gloss of the layer surface even when preserved under a highly moist condition.

The above objects of the present invention are accomplished by a silver halide light-sensitive photographic material which comprises a support and, provided thereon, photographic component layers including at least one silver halide emulsion layer, said photographic component layers containing a compound of Formula [I] and/or Formula [II]:

$$R_1OOC—R_2—COO\text{-}(R_3—OOC—R_2—COO)_n\text{-}R_4 \quad [I];$$

$$R_5O—R_6\text{-}(OOC—R_7—COO—R_6)_n\text{-}OR_8 \quad [II];$$

wherein $R_1$ and $R_4$ are independently selected from the group consisting of an alkyl group, an alkenyl group, a cycloalkyl group, aryl group and a heterocyclic group; $R_2$, $R_3$, $R_6$ and $R_7$ are divalent groups independently selected from the group consisting of an alkylene group, an alkenylene group, a cycloalkylene group and a group of any combination of these groups; $R_5$ and $R_8$ are independently selected from the group consisting of an acyl group and a phosphonyl group; and n is an integer of from 1 to 20.

The present invention will now be explained further in detail:

In the above Formulas [I] and [II], the alkyl group represented by the $R_1$ or $R_4$ is preferably one having from 1 to 32 carbon atoms, which may be either straight-chain or branched-chain and allowed to have a substituent such as, e.g., an aryl, cycloalkyl, alkoxy, aryloxy, alkylthio, arylthio, anilino, sulfonamido, acyloxy, alkoxycarbonyl or aryloxycarbonyl group; particular examples of the substituent include methyl, ethyl, i-propyl, butyl, 2-ethylhexyl, octyl, dodecyl, stearyl, 1-hexylnonyl, 2-chloro-t-butyl, trifluoromethyl, 2,4-di-t-amylphenoxymethyl, 1-(2,4-di-t-amylphenoxy)-propyl and the like groups.

The alkenyl group is preferably one having from 2 to 32 carbon atoms, which may be either straight-chain or branched-chain and allowed to have a substituent such as an allyl, hexenyl, decenyl, pentadecenyl, oleyl or the like group.

The cycloalkyl group is preferably one having from 4 to 12 carbon atoms, such as a cyclopentyl, cyclohexyl or the like group.

The aryl group is preferably a phenyl group, which may be allowed to have a substituent such as an alkyl, alkoxy, acylamino or the like group. Examples of the aryl group include phenyl, naphthyl, 4-t-butylphenyl, 2,4-di-t-amylphenyl, hexadesiloxyphenyl and the like groups.

The heterocyclic group is preferably a 5- to 7-member heterocyclic group which may be either substituted or condensed, and examples of which include 2-furyl, 2-thienyl, 2-pyrimidinyl, 2-benzothiazolyl and the like groups.

The alkylene and alkenylene groups represented by the $R_2$, $R_3$, $R_6$ or $R_7$ may each have a substituent, the substituents being allowed to combine with each other to form a 5- or 6-member saturated ring. Particular examples of the alkylene and alkenylene groups include 1,2-ethylene, 1,3-propylene, 1,4-butylene, 1,3-butylene, 1,6-hexylene, 1,8-octylene, 2,2-(4,4'-dihydroxydicylohexyl)-1,3-pyropylene, vinylene, propenylene, 2-butenylene, 1-hexyl-3-undecenylene, 4-propyl-2-pentenylene,

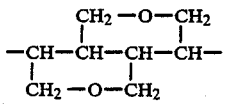

and the like groups.

The cycloalkylene group is such as 1,4-cyclohexylene group. And examples of the bivalent group formed by combination of these groups include

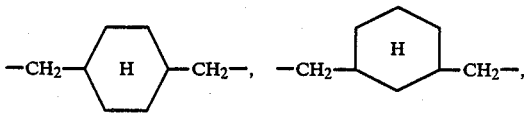

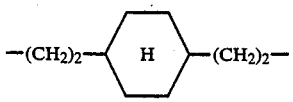

and the like.

The acyl group represented by the $R_5$ or $R_8$ is an alkylcarbonyl, arylcarbonyl, or the like group, and the phosphonyl group is an alkylphosphonyl, alkoxyphosphonyl, aryloxyphosphonyl, arylphosphonyl or the like group. Examples of these alkyl and aryl groups include similar groups to those as the alkyl and aryl groups defined in the foregoing $R_1$ and $R_4$.

The compounds having Formulas [I] and [II] usable in this invention are not ones generally called 'polymers' but low-polymerization-degree ones, so-called oligomers: namely, the n is 1 to 20, but preferably from 1 to 10, and more preferably from 2 to 7.

These oligomers may also be in the form of a mixture of several kinds different in the molecular weight. The mixture may be prepared either in the manner that monomolecular oligomers, after their synthesis, are mixed, or in the manner of adjusting the molecular weight distribution at the time of the synthesis of oligomers.

Preferred among the compounds having Formula [I] or [II] are those compounds having the following Formula [Ia] or [IIa]:

Formula [Ia]

$$R_1OOC(CH_2)n'COO\text{-}(R_3'\text{—}OOC(CH_2)n'COO)_{n''}\text{-}R_4$$

Formula [IIa]

$$R_5'COO\text{—}R_6'\text{-}(OOC(CH_2)n'COO\text{—}R_6')_{n''}\text{-}OOCR_8'$$

wherein $R_1$ and $R_4$ are the same as the $R_1$ and $R_4$, respectively, as defined in Formula [I]; $R_2'$ and $R_6'$ each is a straight-chain or branched-chain alkylene group having from 2 to 8 carbon atoms; $R_t'$ and $R_8'$ each is an alkyl or aryl group; n' is an integer of from 2 to 10; and n'' is an integer of from 1 to 10. Preferred among the compounds having Formula [Ia] or [IIa] are those in which the n' is from 4 to 8 and the $R_3'$ and $R_6'$ each is a straight-chain or branched-chain alkyl group having from 3 or 4 carbon atoms.

More preferred are those compounds having the following Formula [Ib] or [IIb]:

$$R_1OOC(CH_2)n'COO\text{-}\underset{\underset{CH_3}{|}}{CH}(CH_2)n'''OOC(CH_2)n'COO\text{-}_{n''}\text{-}R_4 \qquad \text{Formula [Ib]}$$

$$R_5'COO\underset{\underset{CH_3}{|}}{CH}(CH_2)n'''\text{-}OOC(CH_2)n'COO\underset{\underset{CH_3}{|}}{CH}(CH_2)n'''\text{-}_{n''}\text{-}OOCR_8' \qquad \text{Formula [IIb]}$$

wherein $R_1$, $R_4$, $R_5'$, $R_8'$, n' and n'' are as defined in Formula [Ia] or [IIa]; n''' is an integer of 1 or 2. The most preferred among the compounds having Formula [Ib] or [IIb] are those in which the $R_1$, $R_4$, $R_5'$ and $R_8'$ each is a straight-chain or branched-chain alkyl group, and further preferred are those high-boiling organic solvents of which the vapor pressure at 100° C. is not more than 0.5 mmHg.

The following are examples of the compounds having Formulas [I] and [II] of this invention, but the invention is not limited to and by the examples.

$$C_4H_9OOC(CH_2)_4COO\text{-}\underset{\underset{CH_3}{|}}{CH_2CH}OOC(CH_2)_4COO\text{-}_{n}C_4H_9 \qquad n\approx4 \qquad \text{I-1}$$

$$CH_3OOC(CH_2)_4COO\text{-}\underset{\underset{CH_3}{|}}{CH_2CH}OOC(CH_2)_4COO\text{-}_{n}CH_3 \qquad n\approx3 \qquad \text{I-2}$$

$$C_2H_5OOC(CH_2)_4COO\text{-}\underset{\underset{CH_3}{|}}{CH_2CH}OOC(CH_2)_4COO\text{-}_{n}C_2H_5 \qquad n\approx3 \qquad \text{I-3}$$

$$C_3H_7OOC(CH_2)_4COO\text{-}\underset{\underset{CH_3}{|}}{CH_2CH}OOC(CH_2)_4COO\text{-}_{n}C_3H_7 \qquad n\approx3 \qquad \text{I-4}$$

-continued $C_4H_9OOC(CH_2)_4COO\left[CH_2\underset{\underset{CH_3}{|}}{C}HOOC(CH_2)_4COO\right]_nC_4H_9$ $n\approx2$ I-5

$C_5H_{11}OOC(CH_2)_4COO\left[CH_2\underset{\underset{CH_3}{|}}{C}HOOC(CH_2)_4COO\right]_nC_5H_{11}$ $n\approx3$ I-6

$CH_3OOC(CH_2)_8COO\left[CH_2\underset{\underset{CH_3}{|}}{C}HOOC(CH_2)_8COO\right]_nCH_3$ $n\approx1$ I-7

$C_4H_9\underset{\underset{C_2H_5}{|}}{C}HCH_2OOC(CH_2)_4COO\left[\underset{\underset{CH_3}{|}}{C}HCH_2OOC(CH_2)_4COO\right]_nCH_2\underset{\underset{C_2H_5}{|}}{C}HC_4H_9$ $n\approx7$ I-8

$C_4H_9\underset{\underset{C_2H_5}{|}}{C}HCH_2OOC(CH_2)_4COO\left[\underset{\underset{CH_3}{|}}{C}HCH_2OOC(CH_2)_4COO\right]_nCH_2\underset{\underset{C_2H_5}{|}}{C}HC_4H_9$ $n\approx6$ I-9

$C_4H_9\underset{\underset{C_2H_5}{|}}{C}HCH_2OOC(CH_2)_4COO\left[\underset{\underset{CH_3}{|}}{C}HCH_2OOC(CH_2)_4COO\right]_nCH_2\underset{\underset{C_2H_5}{|}}{C}HC_4H_9$ $n\approx3$ I-10

$C_4H_9\underset{\underset{C_2H_5}{|}}{C}HCH_2OOC(CH_2)_4COO\left[\underset{\underset{CH_3}{|}}{C}HCH_2OOC(CH_2)_4COO\right]_nCH_2\underset{\underset{C_2H_5}{|}}{C}HC_4H_9$ $n\approx1$ I-11

$C_4H_9\underset{\underset{C_2H_5}{|}}{C}HCH_2OOC(CH_2)_6COO\left[\underset{\underset{CH_3}{|}}{C}HCH_2OOC(CH_2)_6COO\right]_nCH_2\underset{\underset{C_2H_5}{|}}{C}HC_4H_9$ $n\approx4$ I-12

$C_4H_9\underset{\underset{C_2H_5}{|}}{C}HCH_2OOC(CH_2)_8COO\left[\underset{\underset{CH_3}{|}}{C}HCH_2OOC(CH_2)_8COO\right]_nCH_2\underset{\underset{C_2H_5}{|}}{C}HC_4H_9$ $n\approx3$ I-13

$C_4H_9\underset{\underset{C_2H_5}{|}}{C}HCH_2OOC\underset{\underset{C_6H_{13}}{|}}{C}{=}CH(CH_2)_7COO\left[\underset{\underset{CH_3}{|}}{C}HCH_2OOC\underset{\underset{C_6H_{13}}{|}}{C}{=}CH(CH_2)_7COO\right]_nCH_2\underset{\underset{C_2H_5}{|}}{C}HC_4H_9$ $n\approx2$ I-14

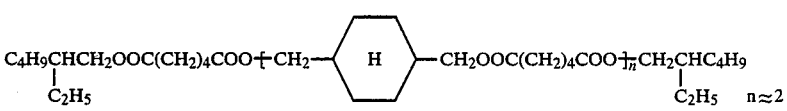

I-15

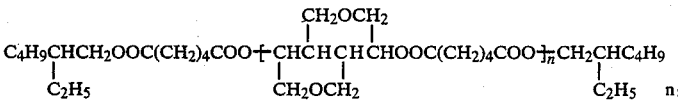

I-16

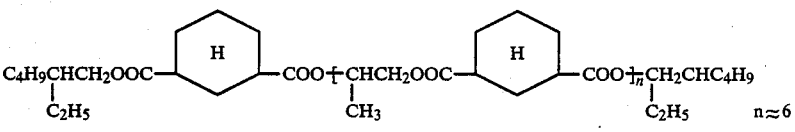

I-17

$C_4H_9OOCCH{=}CHCOO\left[\underset{\underset{CH_3}{|}}{C}HCH_2CH_2OOCCH{=}CHCOO\right]_nC_4H_9$ $n\approx5$ I-18

$C_{12}H_{25}OOCCH_2CH{=}CHCOO\left[\underset{\underset{CH_3}{|}}{C}HCH_2CH_2OOCCH_2CH{=}CHCOO\right]_nC_{12}H_{25}$ $n\approx5$ I-19

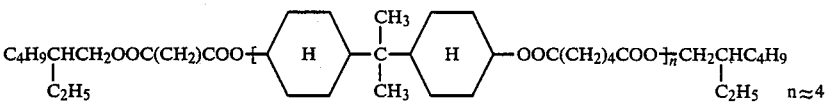

I-20

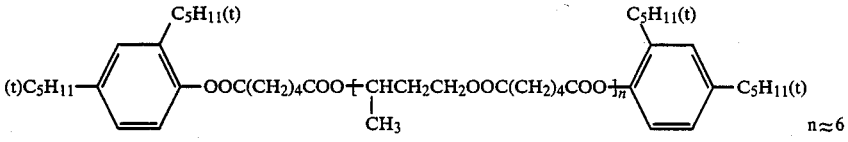

I-21

-continued

I-22

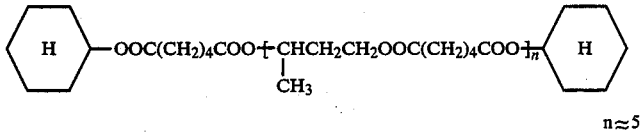

$n \approx 5$

I-23

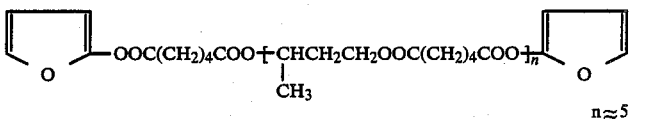

$n \approx 5$

I-24

$C_{12}H_{25}OOC(CH_2)_4COO\text{+}CH(CH_3)CH_2CH_2OOC(CH_2)_4COO\text{+}_nC_{12}H_{25}$ $n \approx 9$

I-25

$C_4H_9OOC(CH_2)_4COO\text{+}CH(CH_3)CH_2CH_2OOC(CH_2)_4COO\text{+}_nC_4H_9$ $n \approx 6$

I-26

$CH_2(O)CH(CH_2)_4OOC(CH_2)_4COO\text{+}CH(CH_3)CH_2CH_2OOC(CH_2)_4COO\text{+}_n(CH_2)_4CH(O)CH_2$ $n \approx 6$

II-1

$C_{11}H_{23}COOCH(CH_3)CH_2CH_2\text{+}OOC(CH_2)_4COOCH(CH_3)CH_2CH_2\text{+}_nOOCC_{11}H_{23}$ $n \approx 4$

II-2

$C_{11}H_{23}COOCH(CH_3)CH_2\text{+}OOC(CH_2)_4COOCH(CH_3)CH_2\text{+}_nOOCC_{11}H_{23}$ $n \approx 4$

II-3

$C_8H_{17}COOCH(CH_3)CH_2CH_2\text{+}OOC(CH_2)_4COOCH(CH_3)CH_2CH_2\text{+}_nOOCC_8H_{17}$ $n \approx 4$

II-4

$C_8H_{17}COOCH(CH_3)CH_2\text{+}OOC(CH_2)_4COOCH(CH_3)CH_2\text{+}_nOOCC_8H_{17}$ $n \approx 4$

II-5

$C_{11}H_{23}COOCH(CH_3)CH_2CH_2\text{+}OOC(CH_2)_6COOCH(CH_3)CH_2CH_2\text{+}_nOOCC_{11}H_{23}$ $n \approx 16$

II-6

$C_{11}H_{23}COOCH(CH_3)CH_2CH_2\text{+}OOC(CH_2)_8COOCH(CH_3)CH_2CH_2\text{+}_nOOCC_{11}H_{23}$ $n \approx 5$

II-7

$C_8H_{17}COOCH(C_6H_{13})CH{=}CH(CH_2)_7\text{+}OOCCH(CH_3)CH_2CH_2COOCH(C_6H_{13})CH{=}CH(CH_2)_7\text{+}_nOOCC_8H_{17}$ $n \approx 6$

II-8

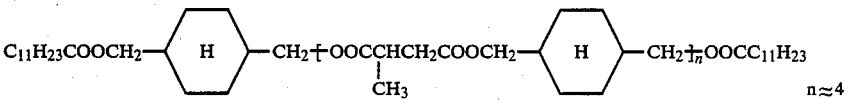

$n \approx 4$

II-9

$C_{11}H_{23}COOCH(CH_2OCH_2)CH(CH_2OCH_2)CH\text{+}OOCCH(CH_3)CH_2CH_2COOCH(CH_2OCH_2)CH(CH_2OCH_2)CH\text{+}_nOOCC_{11}H_{23}$ $n \approx 3$

II-10

$C_8H_{17}COOCH(CH_3)CH_2CH_2\text{+}OOCCH{=}CHCOOCH(CH_3)CH_2CH_2\text{+}_nOOCC_8H_{17}$ $n \approx 5$

II-11

$C_{11}H_{23}COOCH(CH_3)CH_2\text{+}OOCCH_2CH{=}CHCOOCH(CH_3)CH_2\text{+}_nOOCC_{11}H_{23}$ $n \approx 6$ -continued

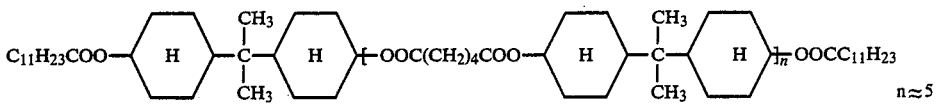

II-12

$(C_8H_{17}O)_2POOCHCH_2CH_2\text{-}OOC(CH_2)_4COOCHCH_2CH_2\text{-}OOP(OC_8H_{17})_2$ (CH₃ at each CHCH₂; n≈6)

II-13

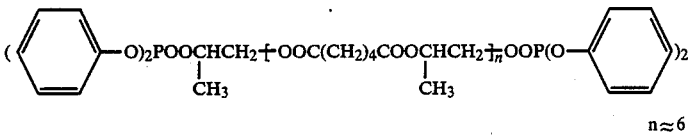

II-14

Any of these compounds can be syntheized generally by a method in which a dibasic acid is made react with a glycol to form an ester oligomer, and the ester oligomer's terminal is then blocked by a monobasic acid or a monoalcohol. The terminal blocking agent may be mixed into the reaction system in the initial stage of the reaction or after the formation of the ester oligomer. A typical example of the synthesis is as follows:

SYNTHESIS EXAMPLE (SYNTHESIS OF COMPOUND I-1)

Ten moles of adipic acid and 8 moles of 1,2-propylene glycol are dissolved into 400 ml of toluene, and the solution is then heated at a temperature of about 160° C. to distill off the water. Upon reaching an acid value of 140, the liquid is heated up to 200° C. to distill off the toluene. After being cooled, this, with 5 moles of butanol added thereto, is heated at 160° C. to react therewith and distill off the water. Upon reaching an acid value of 6, the butanol is distilled off. After being cooled, the liquid is washed by an aqueous sodium carbonate solution and distilled water and then dried under reduced pressure, whereby a light-brown viscous liquid is obtained.

As the compound having Formula [I] or [II], those commercially available products such as ADK CIZER PN, ADK CIZER RS (produced by ADEKA ARGUS Chemical Co., Ltd.), SANSOCIZER-P (produced by Shin-Nippon Rika Co., Ltd.), Diacizer-D-600 Series (produced by Mitsubishi Kasei Vinyl Co., Ltd.) and the like may be utilized.

The high-boiling organic solvent having Formula [I] or [II] may be added to any of the light-sensitive layer or non-light-sensitive layer.

In this invention, photographically useful hydrophobic materials such as dye image forming couplers, ultraviolet absorbing agents, antidiscoloration agents, anticolor-mixing agents, rodox compounds, antifoggants, and the like may be finely dispersed by the oil protect-type dispersing method into a hydrophilic colloid layer.

The oil protect-type dispersing method is such that a hydrophobic additive such as a coupler is dissolved into the high-boiling organic solvent of this invention, if necessary, in combination with a low-boiling solvent and/or a water-soluble organic solvent, and the solution, along with a surface active agent, is emulsifiedly dispersed into a hydrophilic binder such as an aqueous gelatin solution by using a dispersing means such as a stirrer, homogenizer, colloid mill, flow jet mixer, ultrasonic disperser or the like, and then the dispersed liquid is added to an objective hydrophilic colloid layer.

In the above method, a process for removing the low-boiling solvent upon the dispersion may also be inserted.

As a high-boiling organic solvent to be used in combination with the high-boiling organic solvent of this invention, an organic solvent having a boiling point of not less than 150° C. and not reacting with the oxidation product of a developing agent may be used, examples of which include phenol derivatives, phthalic acid esters, phosphoric acid esters, citric acid esters, benzoic acid esters, alkylamides, fatty acid esters, trimesic acid esters, and the like.

In this invention, the high-boiling organic solvent combinedly usable is a compound having a dielectric constant of not more than 6.0, including esters such as, for example, phthalic acid esters, phosphoric acid esters, etc., organic acid amides, ketones, hydrocarbon compounds, and the like, which all have a dielectric constant of not less than 6.0, and preferably a high-boiling organic solvent having a dielectric constant of from 1.9 to 6.0 and a vapor pressure at 100° C. of not more than 0.5 mmHg. More preferred among these high-boiling organic solvents are phthalic acid esters and phosphoric acid esters. Further, the high-boiling organic solvent is allowed to be a mixture of two or more kinds thereof.

The dielectric constant herein means a dielectric constant at 30° C.

The following are examples of the compounds as the aforesaid photographically useful materials:

Ultraviolet Absorbing Agents

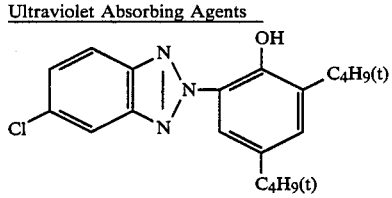

UV-1

-continued
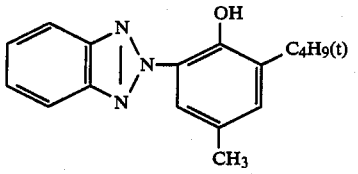
UV-2
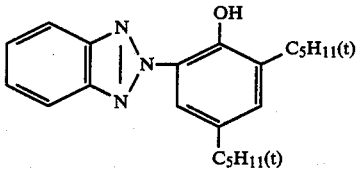
UV-3
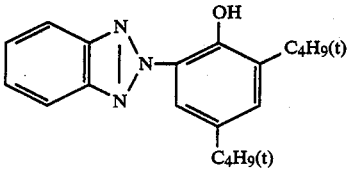
UV-4
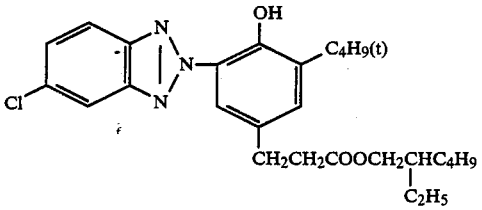
UV-5
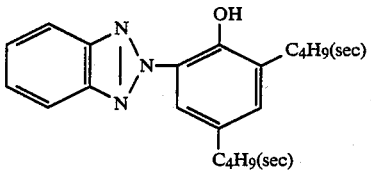
UV-6
Anti-Color-Mixing Agents
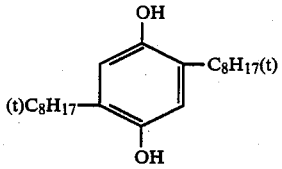
AS-1
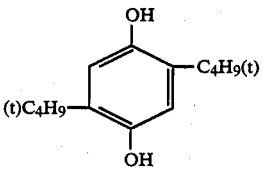
AS-2
Anti-Discoloration Agents
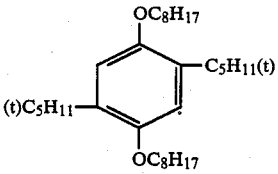
AO-1

-continued

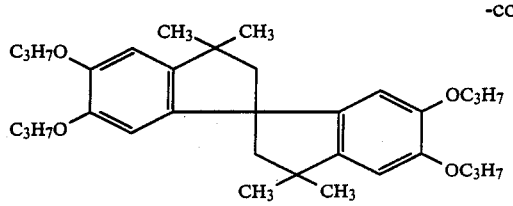

AO-2

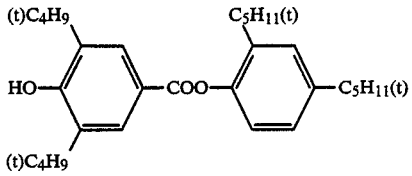

AO-3

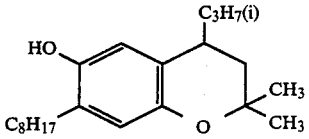

AO-4

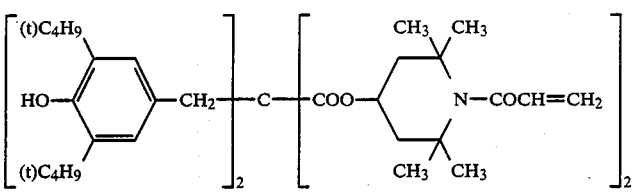

AO-5

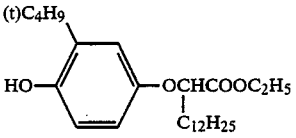

AO-6

The present invention exhibits its effect remarkably in a silver halide light-sensitive photographic material containing particularly dye-forming couplers as the photographically useful material, which may be used along with those various dye-forming couplers known to those skilled in the art.

According to the most preferred embodiment of this invention, the effect of this invention can be exhibited effectively when a compound having the following Formula [M-1] is used as the dye-forming coupler.

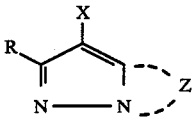

Formula [M-I]

wherein Z is a group of non-metal atoms necessary to form a nitrogen-containing heterocyclic ring, provided that the ring to be formed by the Z may be allowed to have a substituent; X is a hydrogen atom or a group capable of being split off upon the reaction with the oxidation product of a color developing agent; and R is a hydrogen atom or a substituent.

For the formation of a magenta dye image, 5-pyrazolone-type, cyanoacetophenone-type, indazolone-type, pyrazolobenzimidazole-type and pyrazolotriazole-type couplers have conventionally been used. The dye image formed from a 5-pyrazolone-type coupler which has hitherto been used as a magenta coupler is excellent in the resistance against light or heat, but inadequate in the color tone; an undesirable absorption (secondary absorption) having a yellow color component is present in the proximity of 430 nm and the visible rays' absorption spectrum in the proximity of 550 nm is broad, causing the produced color to be turbid, thus resulting in a photographic image lacking in the clearness.

As couplers free of such the undesirable absorption, those 1H-pyrazolo[5,1-c]-1,2,4-triazole-type, 1H-imidazolo[1,2-]pyrazole-type, 1H-pyrazolo[1,5-b]pyrazole-type and 1H-pyrazolo[1,5-d]tetrazole-type couplers as described in U.S. Pat. No. 3,725,067, Japanese Patent O.P.I. Publication Nos. 162548/1984 and 171956 are particularly excellent.

However, the dye image formed from these pyrazoloazole-type couplers, although free of any undesirable absorption in the yellow region, has the disadvantage that the longer wavelength side of the maximum absorption wavelength region of its absorption spectrum is not sharply cut, so that the image becomes of a bluishness-dominant magenta color.

Some compounds capable of shifting the color tone to the shorter wavelength side surely have been found, but those having a large shifting-to-shorter-wavelength effect have shortcomings to largely lower the gradation and deteriorating the color image's resistance to light, or those deteriorating neither gradation nor resistance to light has little shifting-to-shorter-wavelength effect;—thus no compounds capatible with both aspects have yet been found.

According to the preferred embodiment of this invention, by using a magenta coupler capable of forming a magenta color image excellent in the spectral absorption characteristic, a silver halide light-sensitive photographic material having an excellent color reproduction of the magenta color image, a high contrast gradation and an excellent resistance to light can be obtained.

In the magenta coupler having the foregoing Formula [M-I]

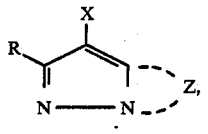

Formula [M-I]

Z is a group of non-metal atoms necessary to form a nitrogen-containing heterocyclic ring, and the ring formed by the Z may have a substituent.

X is a hydrogen atom or a group capable of being split off upon the reaction with the oxidation product of a color developing agent.

R is a hydrogen atom or a substituent.

The substituent represented by the R, although not specially restricted, is typified by alkyl, aryl, anilino, acylamino, sulfonamido, alkylthio, arylthio, alkenyl, cycloalkyl and the like groups, and in addition, by a halogen atom and those groups including cycloalkenyl, alkinyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl and heterocyclic thio groups, and spiro compound residue, cross-linked hydrocarbon compound residue and the like.

The alkyl group represented by the R is preferably a straight-chain or branched-chain alkyl group having from 1 to 32 carbon atoms.

The aryl group represented by the R is preferably a phenyl group.

The acylamino group represented by the R is preferably an alkylcarbonylamino group, arylcarbonylamino group or the like.

The sulfonamido group represented by the R is such as an alkylsulfonylamino group, arylsulfonylamino group, or the like.

The alkyl and aryl constituents of the alkylthio and arylthio groups are the same as the above alkyl and aryl groups, respectively, represented by the foregoing R.

The alkenyl group represented by the R is one having from 2 to 32 carbon atoms, and the cycloalkyl group is one having from 3 to 12 carbon atoms, and particularly preferably from 5 to 7 carbon atoms. The alkenyl group may be either straight-chain or branched-chain.

The cycloalkenyl group represented by the R is one having from 3 to 12 carbon atoms, and more preferably from 5 to 7 carbon atoms.

The sulfonyl group represented by the R is such as an alkylsulfonyl group, arylsulfonyl group or the like.

The sulfinyl group is such as an alkylsulfinyl group, arylsulfinyl group or the like.

The phosphonyl group is such as an alkylphosphonyl group, alkoxyphosphonyl group, aryloxyphosphonyl group, arylphosphonyl group or the like.

The aryl group is such as an alkylcarbonyl group, arylcarbonyl p or the like.

The carbamoyl group is such as an alkylcarbamoyl group, arylcarbamoyl group or the like.

The sulfamoyl group is such as an alkylsulfamoyl group, arylsulfamoyl group or the like.

The acyloxy group is such as an alkylcarbonyloxy group, arylcarbonyloxy group or the like.

The carbamoyloxy group is such as an alkylcarbamoyloxy group, arylcarbamoyloxy group or the like.

The ureido group is such as an alkylureido group, arylureido group or the like.

The sulfamoylamino group is such as an alkylsulfamoylamino group, arylsulfamoylamino group or the like.

The heterocyclic group is preferably a 5- to 7-member heterocyclic group such as a 2-furyl group, 2-thienyl group, 2-pyrimidinyl group, 2-benzothiazolyl group or the like.

The heterocyclic oxy group is preferably one having a 5- to 7-member heterocyclic ring, such as a 3,4,5,6-tetrahydropyranyl-2-oxy group, 1-phenyltetrazole-5-oxy group or the like.

The heterocyclic thio group is preferably a 5- to 7-member heterocyclic thio group such as a 2-pyridylthio group, 2-benzothiazolylthio group, 2,4-diphenoxy-1,3,5-triazole-6-thio group or the like.

The siloxy group is such as a trimethylsiloxy group, triethylsiloxy group, dimethylbutylsiloxy group or the like.

The imido group is such as a succinic acid imido group, 3-heptadecyl-succinic acid imido group, phthalimido group, glutarimido group or the like.

The spiro compound residue is such as spiro[3.3]heptan-1-yl, or the like.

The cross-linked hydrocarbon compound residue is such as bicyclo[2.2.1]heptan-1-yl, tricyclo[3.3.1.1$^{3,7}$]decan-1-yl, 7,7-dimethyl-bicyclo[2.2.1]heptan-1-yl, or the like.

The group represented by the X, which is capable of being split off upon the reaction with the oxidation product of a color developing agent, is, for example, a halogen atom (such as chlorine, bromine, fluorine) or an alkoxy group, aryloxy group, heterocyclic oxy group, acyloxy group, sulfonyloxy group, alkoxycarbonyloxy group, aryloxycarbonyl group, alkyloxalyloxy group, alkoxyoxalyloxy group, alkylthio group, arylthio group, heterocyclic thio group, alkyloxythiocarbonylthio group, acylamino group, sulfonamido group, nitrogen-containing heterocyclic group combined by a nitrogen atom, alkyloxycarbonylamino group, aryloxycarbonylamino group, carboxyl group, or group having the formula:

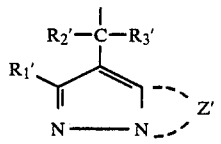

wherein $R_1'$ is as defined in the foregoing R; Z' is as defined in the foregoing Z; $R_2'$ and $R_3'$ each is a hydrogen atom, an aryl, alkyl or heterocyclic group; and preferably a halogen atom, and more preferably a chlorine atom.

The nitrogen-containing heterocyclic ring formed by the Z or Z' is such as a pyrazole ring, imidazole ring, triazole ring or tetrazole ring, which each may have a substituent. Examples of the substituent include those represented by the foregoing R.

The compounds having Formula [M-I], more particularly, include those represented by, e.g., the following Formulas [M-II] through [M-VIII]:

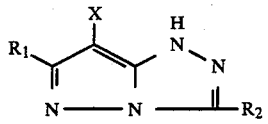

[M-II]

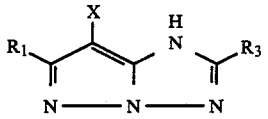

[M-III]

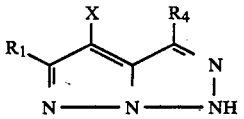

[M-IV]

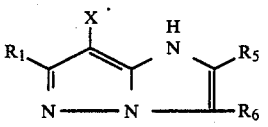

[M-V]

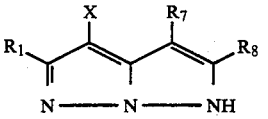

[M-VI]

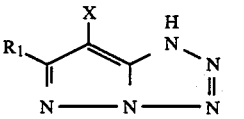

[M-VII]

In the above Formulas [M-II] through [M-VIII], $R_1$ through $R_8$ and X are as defined in the foregoing R and X, respectively.

Further, preferred among the compounds having Formula [M-I] are those having the following Formula [M-VIII]:

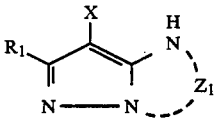

Formula [M-VIII]

wherein $R_1$, X nd $Z_1$ are as defined in the R, X and Z, respectively, of Formula [M-I].

Particularly preferred among the magenta couplers having Formulas [M-II] through [M-VII] are those magenta couplers having Formula [M-II].

The most preferred substituents as the R or $R_1$ to the foregoing heterocyclic ring are those having the following Formula [M-IX]:

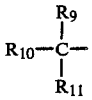

Formula [M-IX]

wherein $R_9$, $R_{10}$ and $R_{11}$ are as defined in the foregoing R.

Two of the $R_9$, $R_{10}$ and $R_{11}$, for example, the $R_9$ and $R_{10}$, may combine with each other to form a saturated or unsaturated ring such as, e.g., cycloalkane, cycloalkene, heterocyclic ring, etc., and the ring may also combine further with the $R_{11}$ to constitute a cross-linked hydrocarbon compound residue.

The preferred case of Formula [M-IX] is where (i) at least two of the $R_9$ through $R_{11}$ are alkyl groups, or (ii) one of the $R_9$ through $R_{11}$, e.g., the $R_{11}$, is a hydrogen atom and the other two, both $R_9$ and $R_{10}$, combine together with the immediate carbon atom to form a cycloalkyl group.

Further, the case (i) is more preferably where two of the $R_9$ and $R_{11}$ are alkyl groups and the other one is a hydrogen atom or an alkyl group.

As the substituent which the ring formed by the Z of Formula [M-I] or the ring formed by the $Z_1$ of Formula [M-VIII] may have and as the $R_2$ through $R_8$ of Formulas [M-II] through [M-VI], those having the following Formula [M-X] are preferred.

$$-R_{12}-SO_2-R_{13}$$

Formula [M-X]

wherein $R_{12}$ is an alkylene group; $R_{12}$ is an alkyl, cycloalkyl or aryl group.

The alkylene group represented by the $R_{12}$ is preferably a straight-chain or branched-chain alkylene group of which the straight-chain portion has not less than 2 carbon atoms, and more preferably 3 to 6 carbon atoms.

The cycloalkyl group represented by the $R_{13}$ is preferably a 5- or 6-cycloalkyl group.

The following are examples representative of the compounds according to this invention.

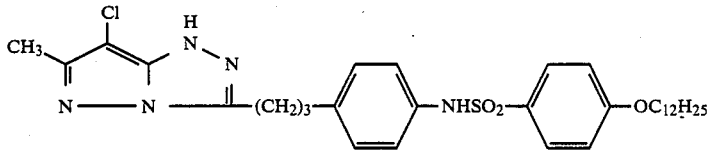

M-1

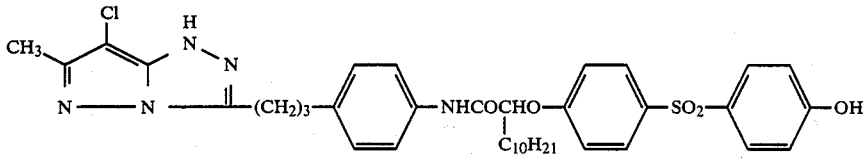

M-2

-continued
M-3
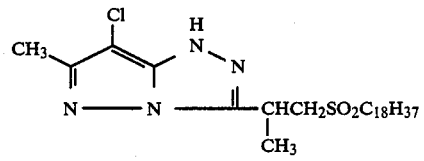
M-4
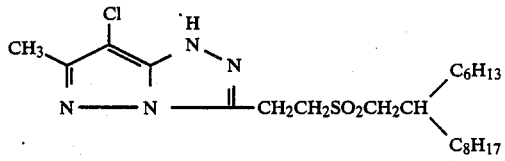
M-5
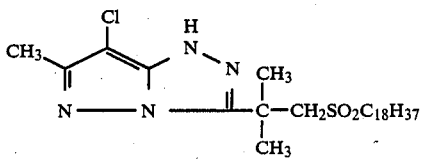
M-6
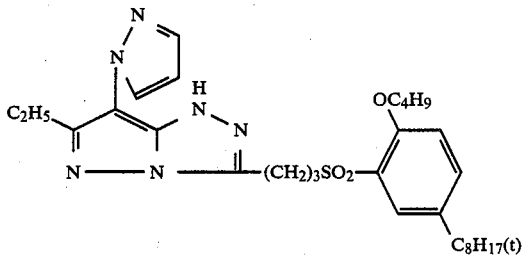
M-7
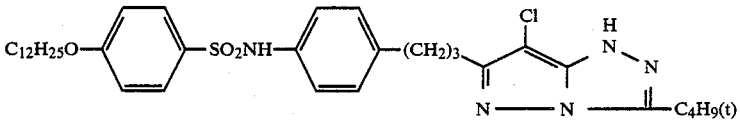
M-8
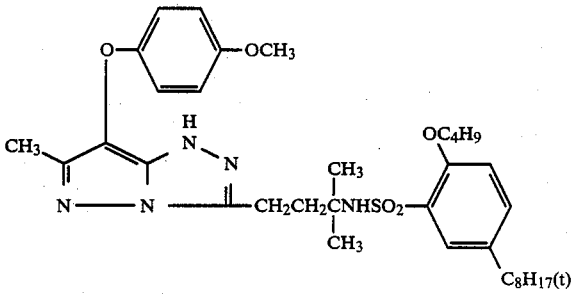
M-9
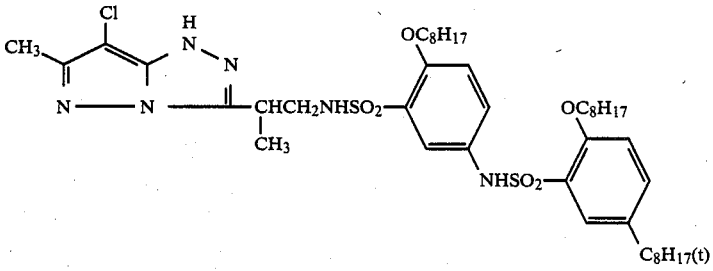

-continued
M-10
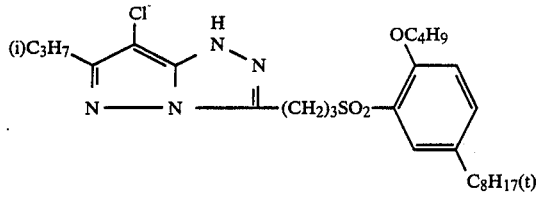
M-11
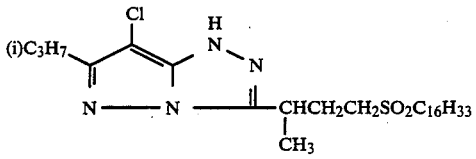
M-12
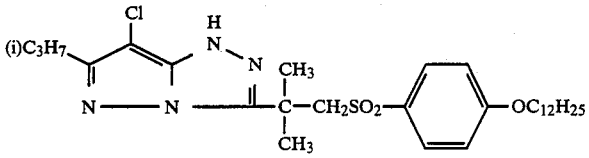
M-13
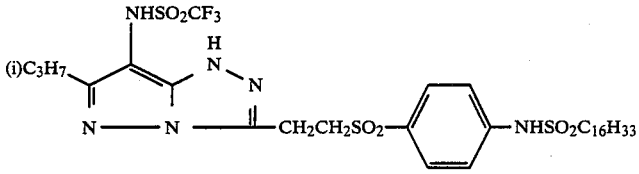
M-14
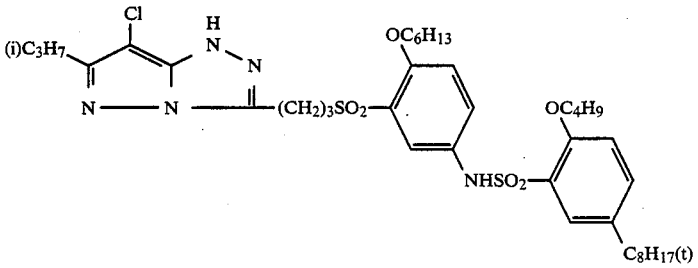
M-15
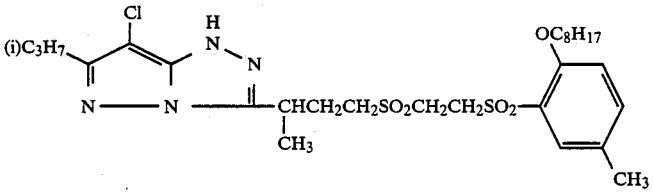
M-16
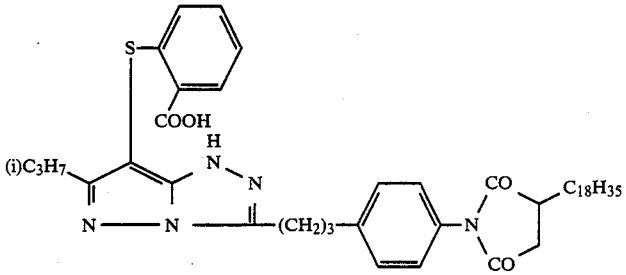
M-17
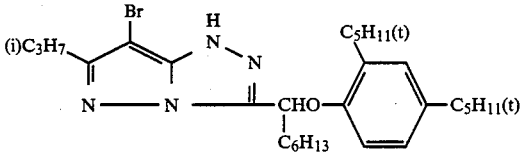

-continued
M-18
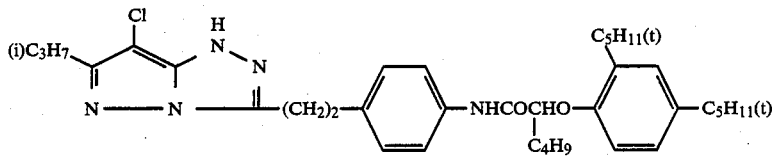
M-19
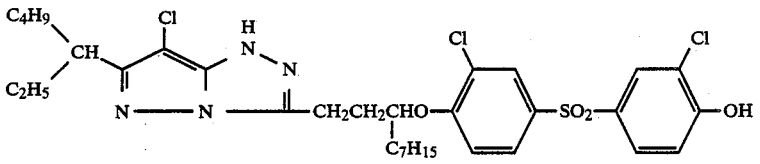
M-20
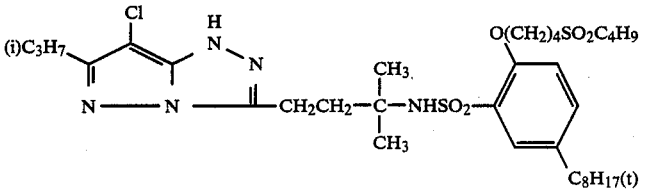
M-21
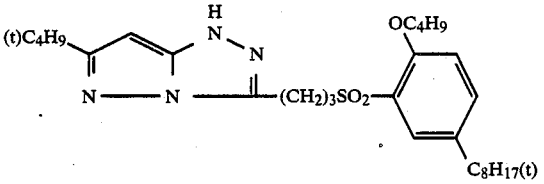
M-22
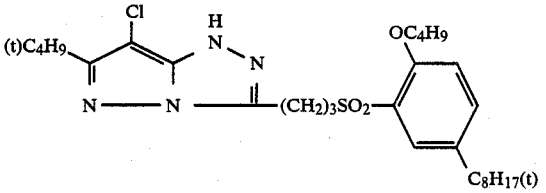
M-23
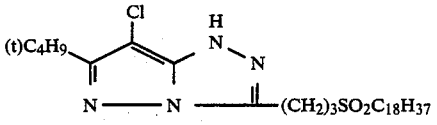
M-24
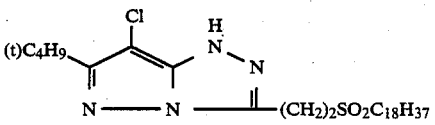
M-25
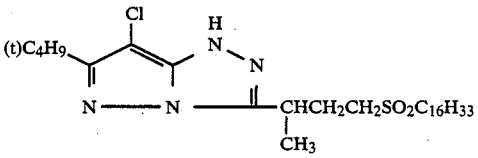
M-26
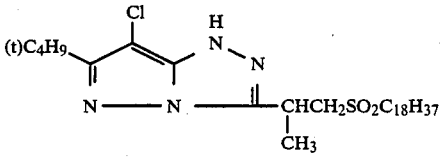

-continued
M-27
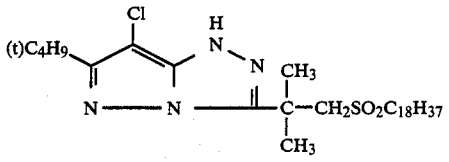
M-28
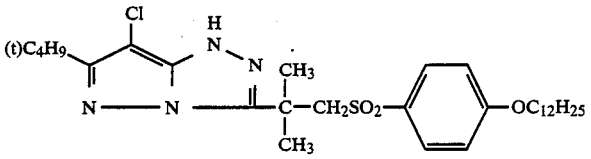
M-29
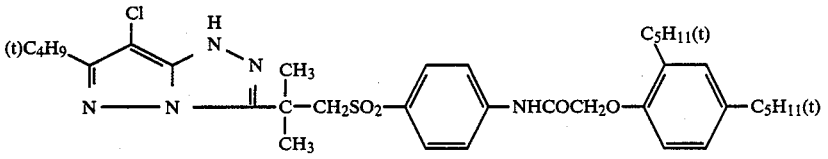
M-30
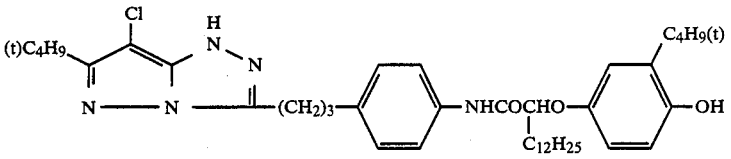
M-31
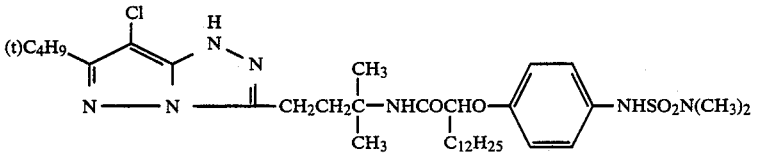
M-32
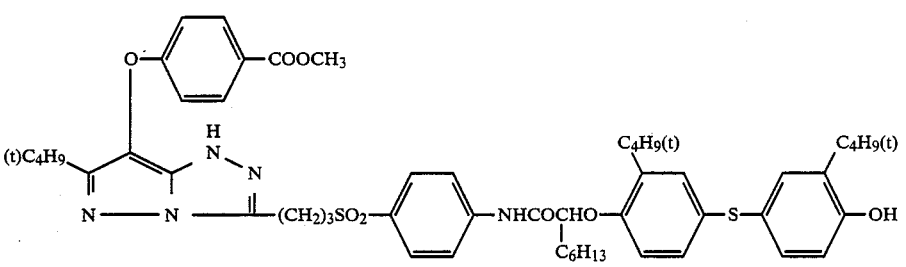
M-33
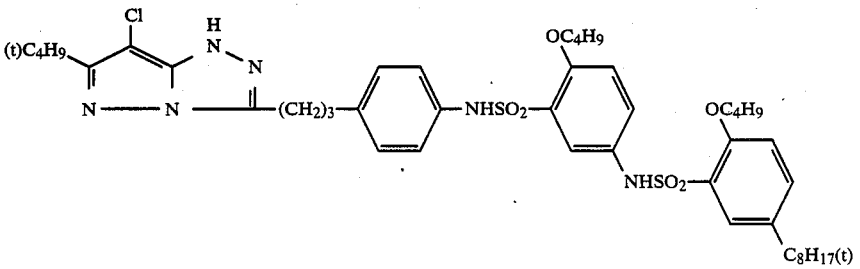
M-34
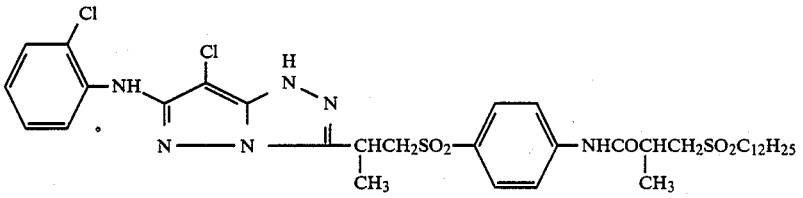

-continued
M-35
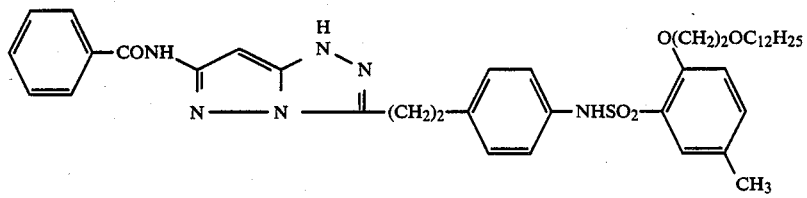
M-36
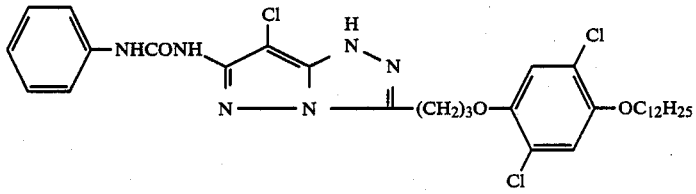
M-37
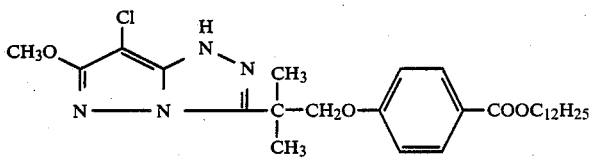
M-38
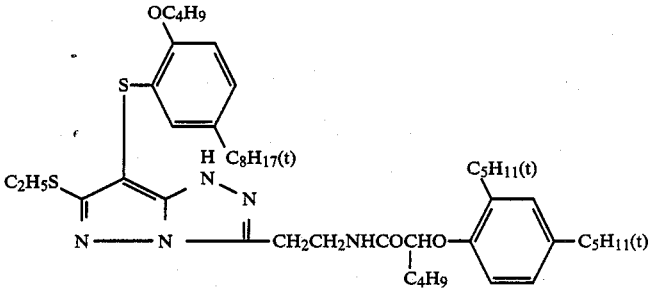
M-39
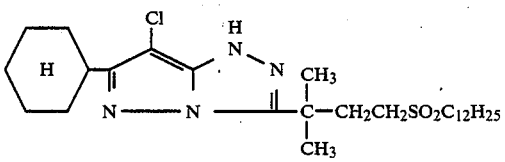
M-40
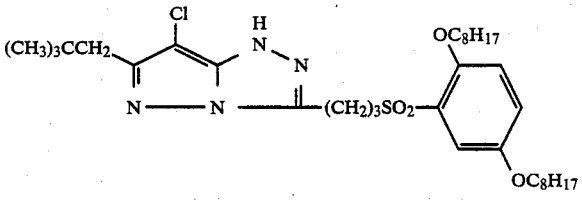
M-41
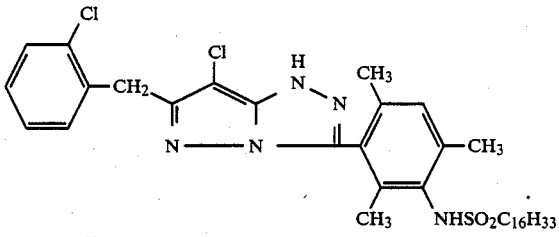
M-42
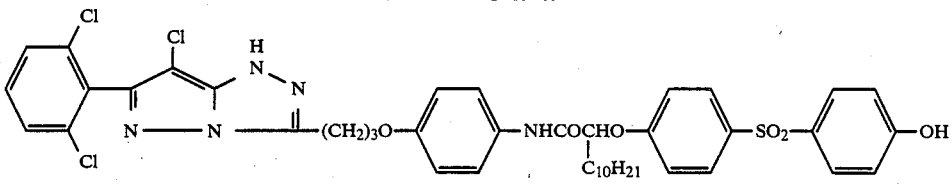

-continued
M-43
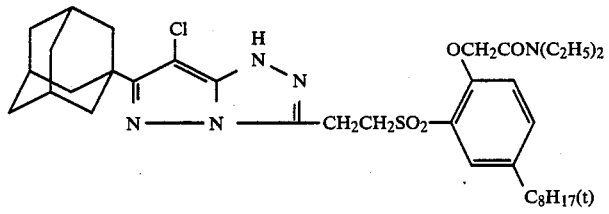
M-44
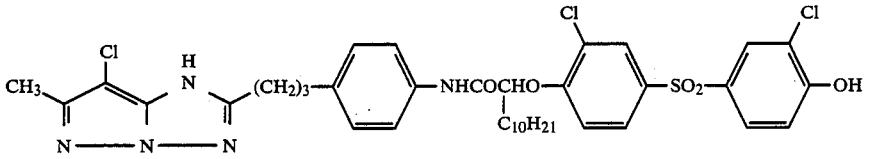
M-45
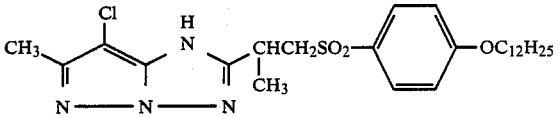
M-46
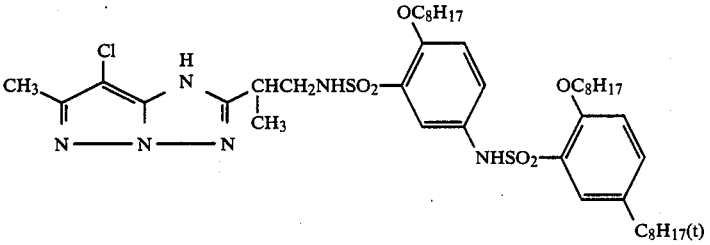
M-47
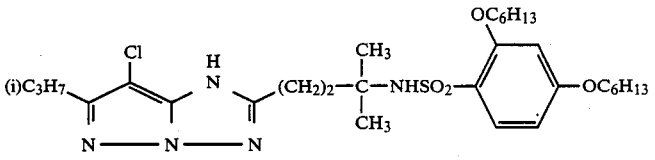
M-48
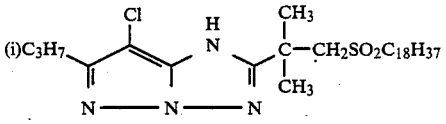
M-49
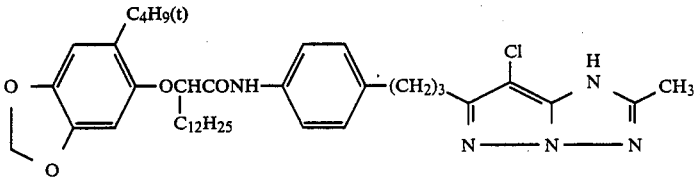
M-50
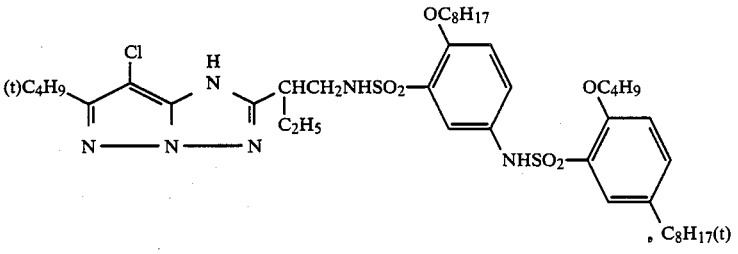

-continued
M-51
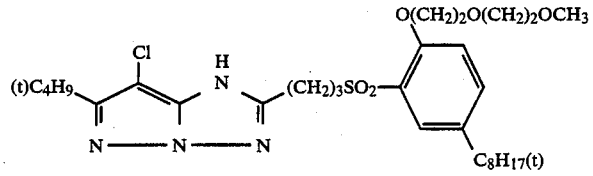
M-52
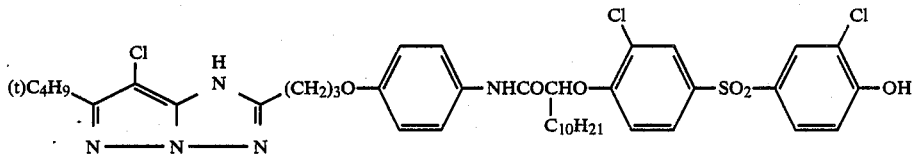
M-53
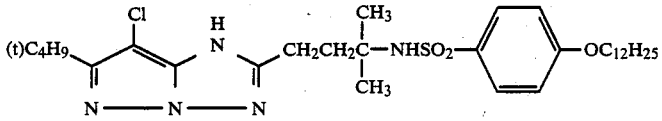
M-54
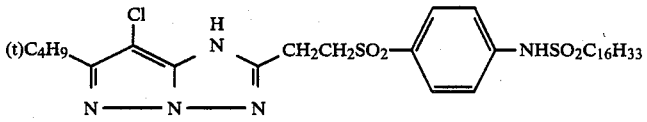
M-55
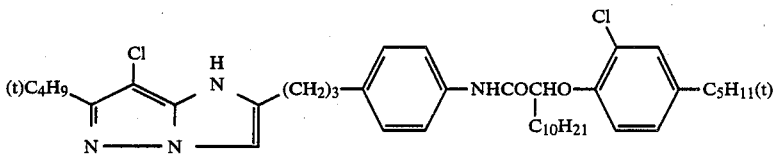
M-56
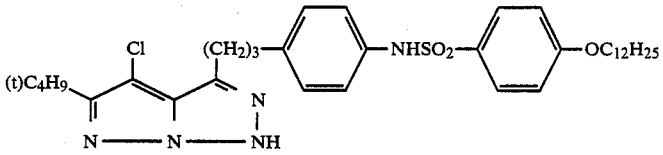
M-57
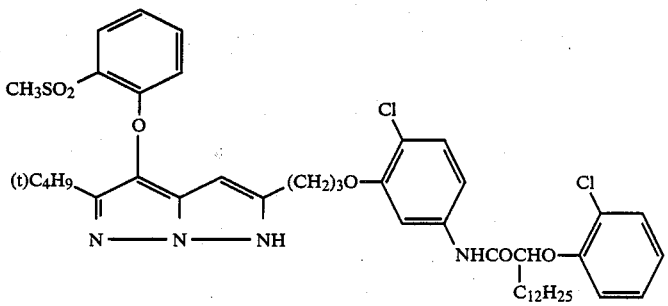
M-58
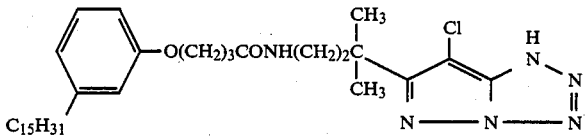

-continued

M-59

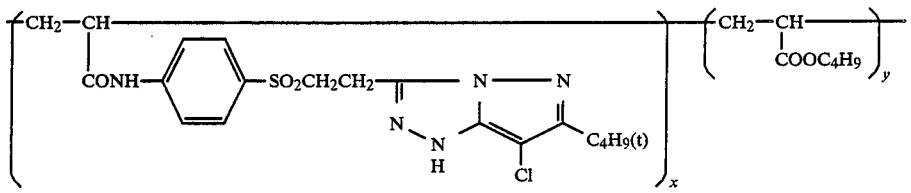

x:y = 50:50

M-60

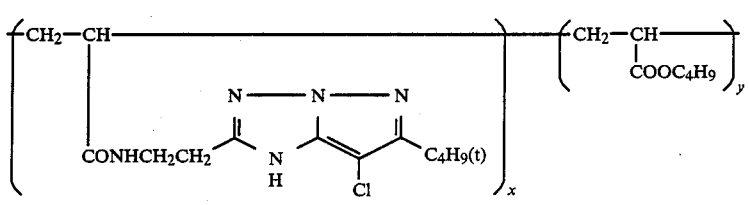

x:y = 50:50

M-61

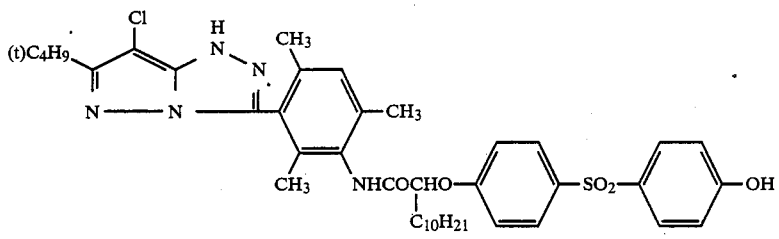

In addition to the above examples representative of the compounds according to this invention, other examples of the compounds usable in this invention also include those compounds Nos. 1 through 4, 6, 8 through 17, 19 through 24, 26 through 43, 45 through 59, 61 through 104, 106 through 121, 123 through 162, and 164 through 223 disclosed in pages 66 through 122 of Japanese Patent O.P.I. Publication No. 9791/1986.

These couplers can be synthesized by making reference to the Journal of the Chemical Society, Perkin, I (1977), 2047–2052, U.S. Pat. No. 3,705,067, Japanese Patent O.P.I. Publication Nos. 99437/1984, 42045/1983, 162548/1984, 171956/1984, 33552/1985, 43659/1985, 172982/1985 and 190779/1985.

The coupler of this invention may be used in the amount range of normally from $1\times10^{-3}$ mole to 1 mole per mole of silver halide, and more preferably from $1\times10^{-2}$ mole to $8\times10^{-1}$ mole.

For the purpose of further improving the light resistance of the magenta coupler in the silver halide light-sensitive photographic material of this invention, it is desirable to use in the magenta coupler-containing silver halide emulsion layer an antidiscoloration agent such as a phenol-type, phenyl-ether-type, hydroxyindane-type, chromancoumarane-type, nitrogen-containing heterocyclic-type (such as pyrolidine, piperazine, piperidine, homopiperazine, homopiperidine, morpholine, thiomorpholine, imidazolidine, hexamethylenimine derivatives) or metal complex salt-type antidiscoloration agent.

The following are examples representative of the antidiscoloration agent suitably usable in this invention:

A0-1

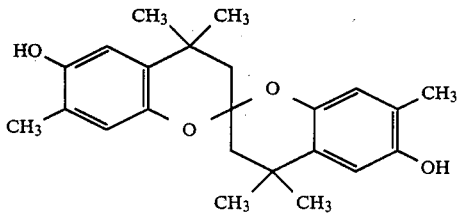

A0-2

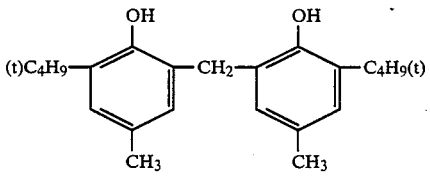

-continued
A0-3
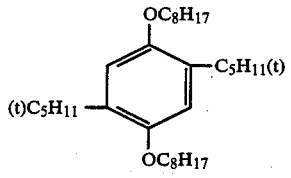
A0-4
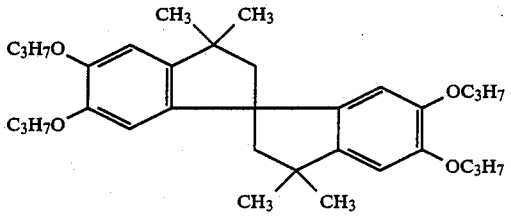
A0-5
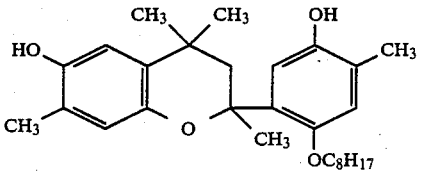
A0-6
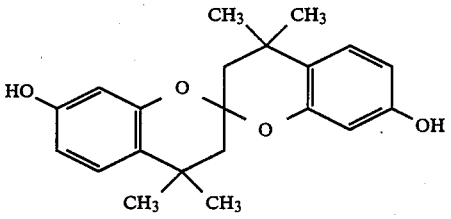
A0-7
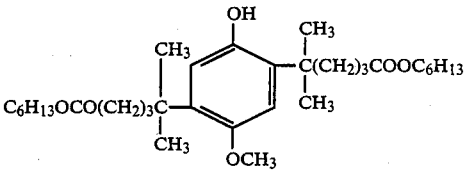
A0-8
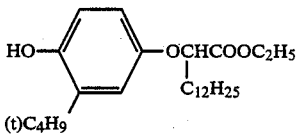
A0-9
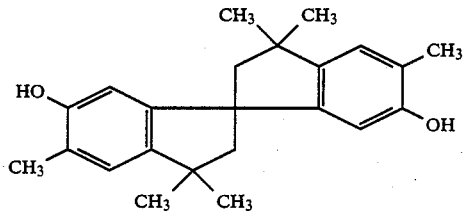
A0-10
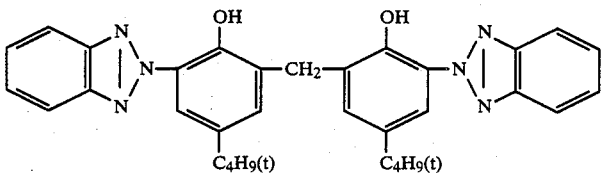

-continued
A0-11
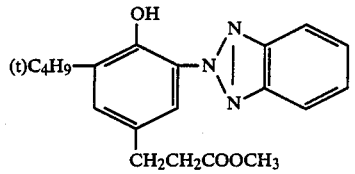
A0-12
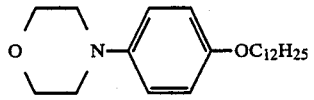
A0-13
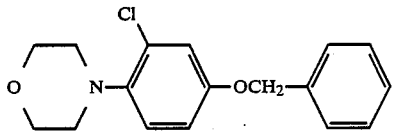
A0-14
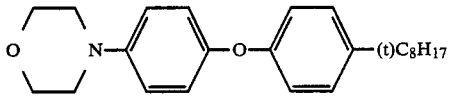
A0-15
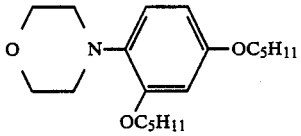
A0-16
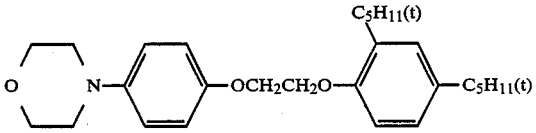
A0-17
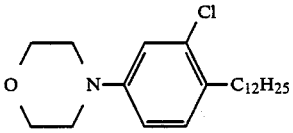
A0-18
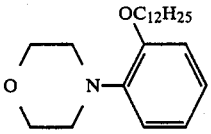
A0-19
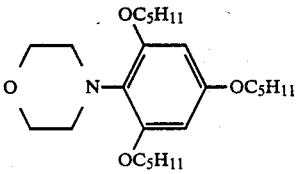
A0-20
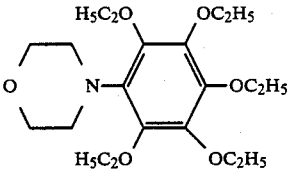
A0-21
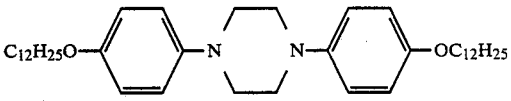

-continued
A0-22
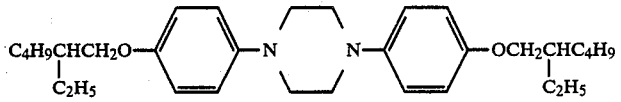
A0-23
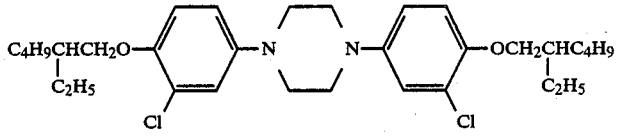
A0-24
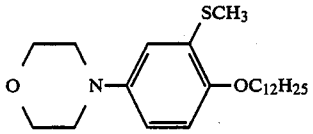
A0-25
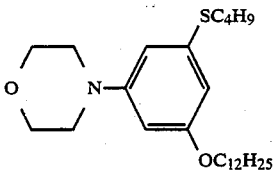
A0-26
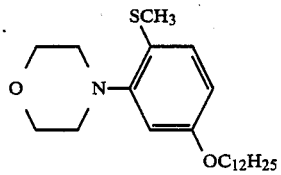
A0-27
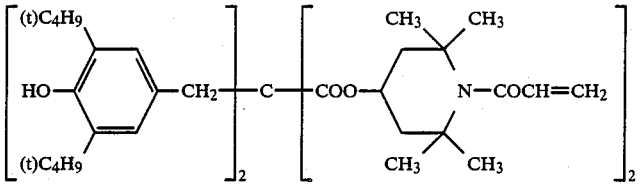
A0-28
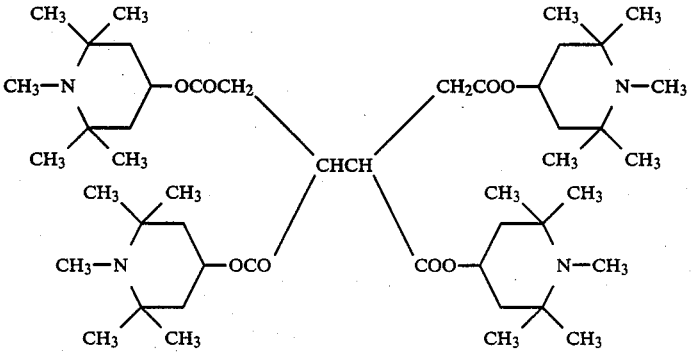
A0-29
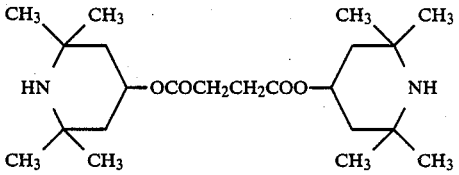

-continued

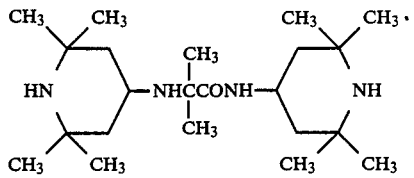

A0-30

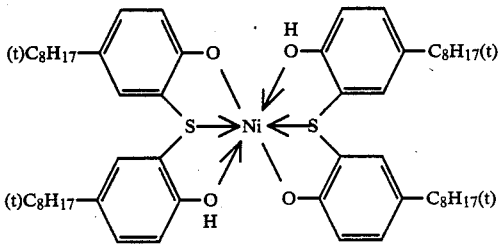

A0-31

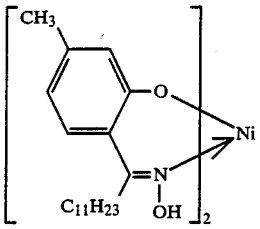

A0-32

These antidiscoloration agents are those compounds as disclosed in Japanese Patent O.P.I. Publication Nos. 72246/1986, 90155/1986, 90156/1986 and the like, and in addition, those compounds as disclosed in Japanese Patent O.P.I. Publication Nos. 267049/1986, 260247/1986, 25757/1987 and the like may also be used.

The antidiscoloration agent is used in the amount range of preperably from 0.1 to 2 moles per mole of the magenta coupler of this invention, and more preferably from 0.3 to 1 mole.

Those yellow couplers and cyan couplers suitably usable in this invention will now be explained.

As the yellow coupler, acylacetamide-type couplers are used, and above all, pivalylacetanilide-type and benzoylacetanilide-type yellow couplers are preferred.

The following are examples representative of the yellow coupler.

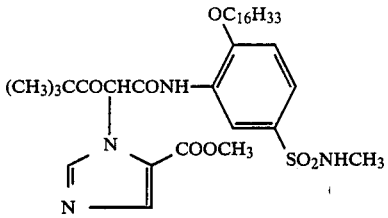

Y-1

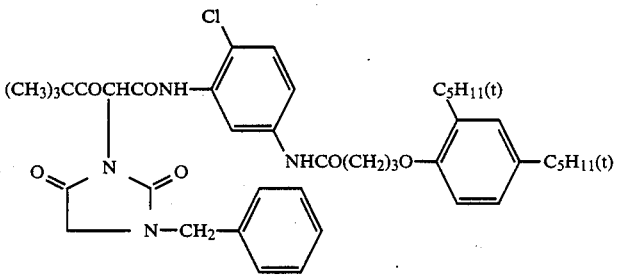

Y-2

-continued
Y-3
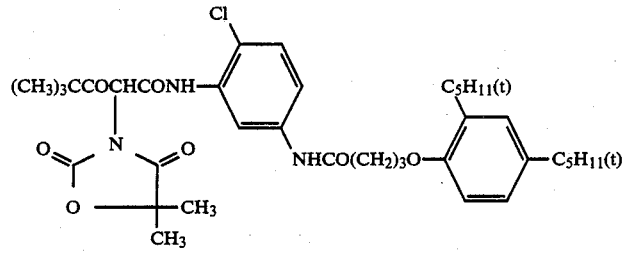
Y-4
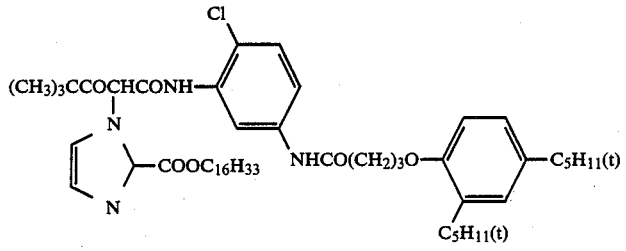
Y-5
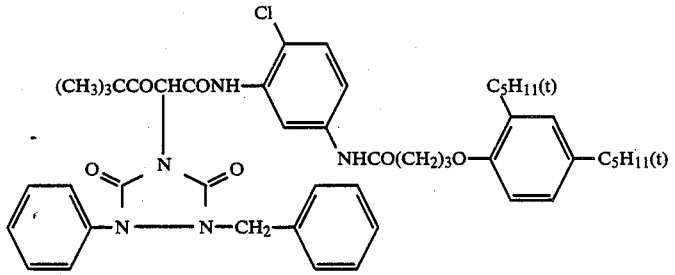
Y-6
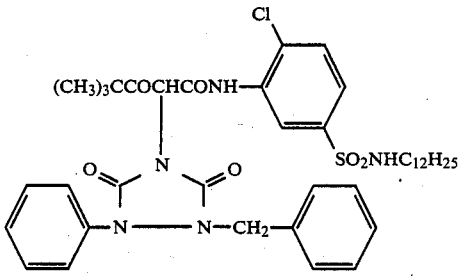
Y-7
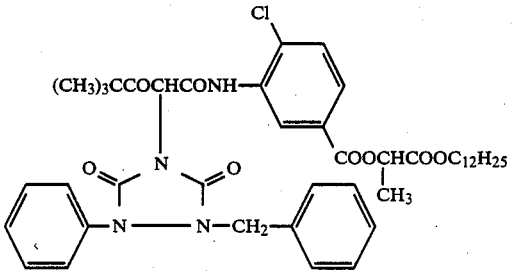
Y-8
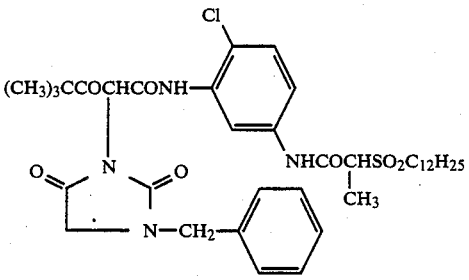

-continued
Y-9
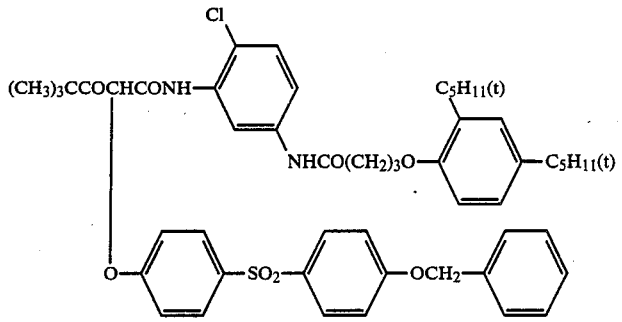
Y-10
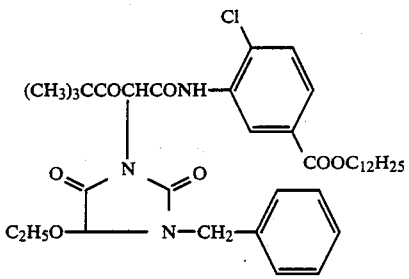
Y-11
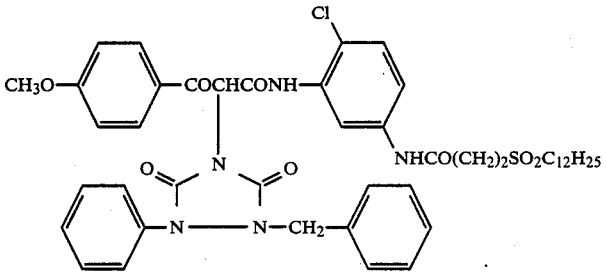
Y-12
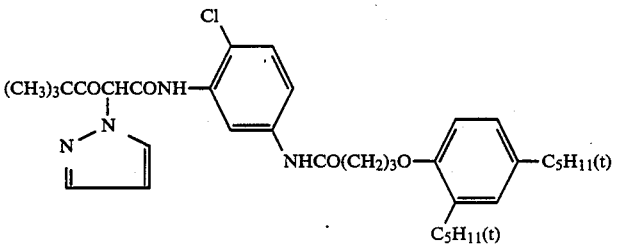
Y-13
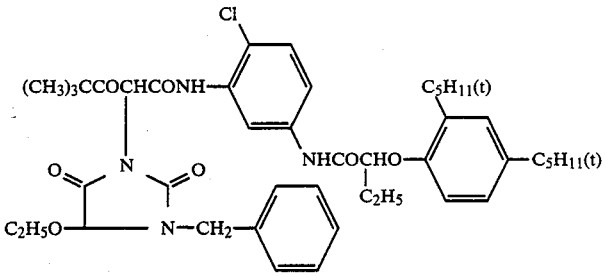

-continued

Y-14

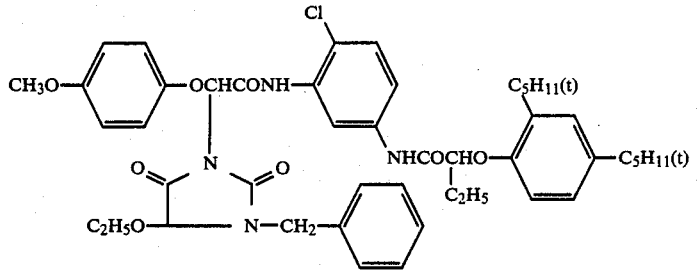

These usable examples of the yellow coupler are those described in Japanese Patent O.P.I. Publication Nos. 26133/1972, 29432/1973, 66834/1973, 102636/1976 and 49349/1987, and U.S. Pat. Nos. 3,265,506, 3,408,194, 4,022,620, 4,256,258, and the like.

As the cyan coupler, phenol-type and naphthol-type couplers are used, and above all, 2,5-diacylaminophenol-type and 3-alkyl-6-acylaminophenol-type cyan couplers are preferred.

According to one of the most preferable embodiments of the invention, in the light-sensitive silver halide photographic material of the invention, a cyan dye-forming coupler represented by Formula [PC-I] can advantageously be used:

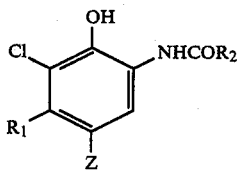

[PC-I]

wherein $R_1$ is a straight-chain or branched-chain alkyl group having 2 to 6 carbon atoms which may have a substituent, $R_2$ is an organic ballasting group having a sufficient size and/or shape to substantially prevent the cyan dye-forming coupler from migrating into other layer, and Z is a hydrogen atom or a substituent capable of being split off upon reaction with the oxidized product of a color developing agent. As a ballasting group, a group having the following formula is preferable:

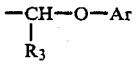

wherein $R_3$ is an alkyl group having 1 to 12 carbon atoms, and Ar is an aryl group such as a phenyl group, and the aryl group may have a substituent.

The following are examples of the cyan coupler:

C-1

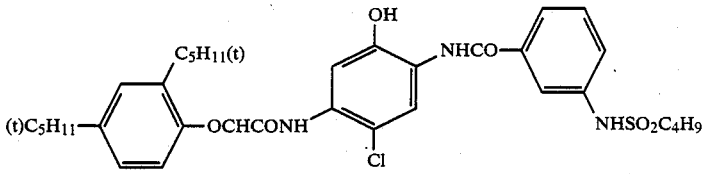

C-2

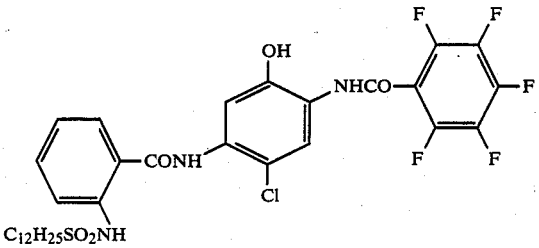

C-3

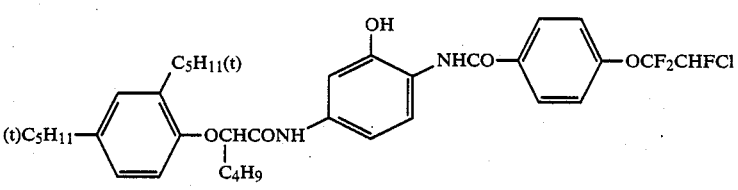

-continued
C-4
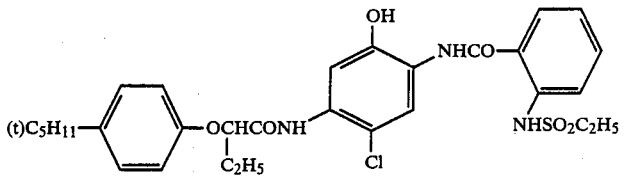
C-5
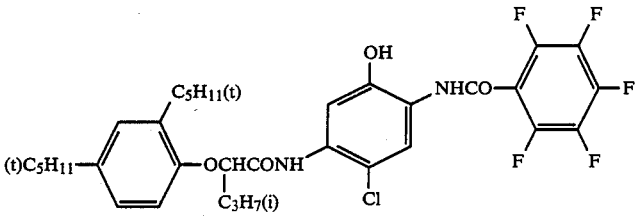
C-6
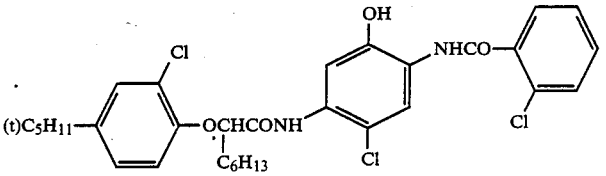
C-7
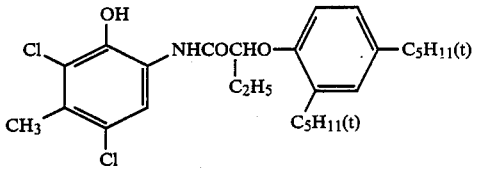
C-8
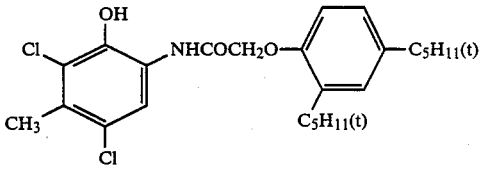
C-9
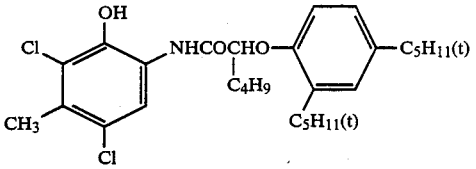
C-10
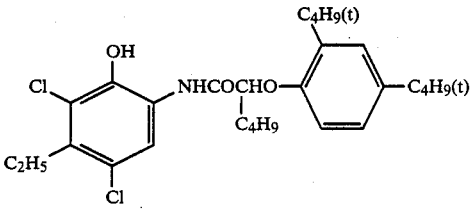
C-11
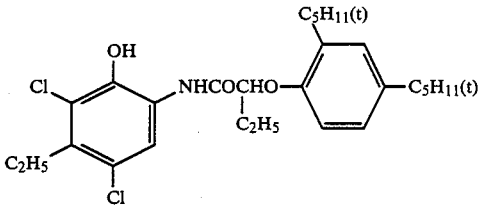

-continued

C-12

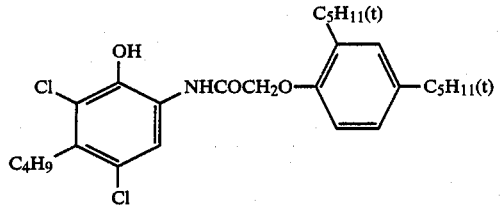

These cyan couplers are described in Japanese Patent O.P.I. Publication Nos. 146050/1984, 117249/1985 and 31953/1984. In this invention, those couplers as described in U.S. Pat. Nos. 2,423,730 and 4,564,590, and Japanese Patent O.P.I. Publication Nos. 222853/1985, 36746/1986, 98348/1986, 167953/1986, 10649/1987, 30251/1987 and the like may also be used.

These yellow couplers and cyan couplers mentioned above, similarly to the foregoing magenta coupler of this invention, may be used in the amount range of normally from $1\times10^{-3}$ mole to 1 mole per mole of silver halide, and preferably from $1\times10^{-2}$ mole to $8\times10^{-1}$ mole.

The incorporation of any of such hydrophobic additives including the foregoing magenta coupler of this invention may be carried out in the manner that an additive is dissolved into a high-boiling organic solvent having a boiling point of not less than about 150° C., if necessary, in combination with a low-boiling and/or water-soluble organic solvent, and the solution is then emulsifiedly dispersed using a surface active agent into a hydrophilic binder such as an aqueous gelatin solution, and then the dispersed liquid is added to a hydrophilic colloid layer.

As the high-boiling organic solvent, phenol derivatives, phtalic acid esters, phosphoric acid esters, citric acid esters, benzoic acid esters, organic acid amides, fatty acid esters, ketones, hydrocarbon compounds and the like, which all do not react with the oxidation product of a developing agent, are generally used. In this invention, as the high-boiling organic solvent having a shifting-to-shorter-wavelength effect for the magenta dye image, at least one of those compounds having the foregoing Formulas [I] and [II] is most desirable to be used.

The silver halide light-sensitive photographic material of this invention can be a color negative or positive film or color photographic paper, and may be for either monochromatic or multicolor use.

In the case of a silver halide light-sensitive multicolor photographic material, the photographic material has a construction comprising normally an arbitrary number of silver halide emulsion layers containing magenta, yellow and cyan couplers and non-light-sensitive layers which are coated in arbitrary order on its support. The number of and the order of such layers may be altered discretionally according to the preferential characteristic or purpose for which the photographic material is used.

The silver halide to be used in the silver halide light-sensitive photographic material of this invention may be any discretionary one for ordinary silver halide emulsions, such as silver bromide, silver iodobromide, silver iodochloride, silver chlorobromide or silver chloride.

The silver halide emulsion to be used in this invention may be chemically sensitized by the sulfur sensitization method, selenium sensitization method, reduction sensitization method, noble-metal sensitization method, and the like.

The silver halide emulsion to be used in this invention may be optically sensitized to any desired wavelength regions by using dyes known as sensitizing dyes to those skilled in the art in the photographic field.

As the binder (or protective colloid) to be used in the silver halide light-sensitive photographic material, gelatin is advantageously used, and aside from this, hydrophilic colloids such as gelatin derivatives, graft polymers of gelatin with other polymers, protein, sugar derivatives, cellulose derivatives, synthetic hydrophilic high-molecular materials such as homo- or co-polymers or the like may also be used.

EXAMPLES

The present invention will be illustrated in detail by the following examples, but the embodiment of the invention is not limited thereto.

EXAMPLE-1

Thirty grams of Exemplified Cyan Coupler C-7, 30 g of Exemplified Cyan Coupler C-5 and 60 g of Antidiscoloration Agent AO-3 were dissolved into a solvent mixture of 40 ml of a high-boiling solvent (DBP) and 100 ml of ethyl acetate, and the solution was added to an aqueous 8% gelatin solution containing a dispersing assistant (sodium dodecylbenzensulfonate), and the mixture was dispersed by means of a homogenizer. The dispersed liquid, after making its whole quantity 1500 ml, was kept warm at 35° C. for three hours, and then added to 1000 ml of an aqueous 3% gelatin solution for coating, and subsequently to this were added 400 g of a red-sensitive silver chlorobromide emulsion (containing 80 mole % silver bromide), whereby a red-sensitive emulsion layer coating liquid was prepared.

This coating liquid was kept warm at 35° C. for 12 hours.

In like manner, the following respective layer coating liquids were prepared. The coating liquids were coated on a polyethylene-coated paper support in order from the support side so as to be of the following construction.

Layer 1: Blue-sensitive emulsion layer

Containing 8 mg/dm$^2$ of Yellow Coupler Y-1, 3 mg/dm$^2$ in silver equivalent of a blue-sensitive silver chlorobromide emulsion (containing 20 mole % silver chloride, 80 mole % silver bromide), 3 mg/dm$^2$ of high-boiling organic solvent (DBP), 4 mg/dm$^2$ of Antidiscoloration Agent AO-27 and 16 mg/dm$^2$ of gelatin.

Layer 2; Intermediate layer Containing 0.45 mg/dm$^2$ of Hydroquinone Derivative HQ-1 and 4 mg/dm$^2$ of gelatin.

Layer 3: Green-sensitive layer

Containing 4 mg/dm$^2$ of Magenta Coupler M-1, 4 mg/dm$^2$ in silver equivalent of a green-sensitive silver chlorobromide emulsion (containing 20 mole % silver chloride, 80 mole % silver bromide), 4 mg/dm$^2$ of a high-boiling organic solvent (DBP), 4 mg/dm$^2$ of Antidiscoloration Agent AO-1 and 16 mg/dm$^2$ of gelatin.

Layer 4: Intermediate layer

Containing 3 mg/dm$^2$ of Ultraviolet Absorbing Agent UV-3 and 3 mg/dm$^2$ of UV-4, 4 mg/dm$^2$ of high-boiling organic solvent (DBP), 0.45 mg/dm$^2$ of Hydroquinone Derivative HQ-2 and 14 mg/dm$^2$ of gelatin.

Layer 5: Red-sensitive emulsion layer

Containing 2 mg/dm$^2$ of Cyan Coupler C-1 and 2 mg/dm$^2$ of C-5, 4 mg/dm$^2$ of a high-boiling organic solvent (DBP), 4 mg/dm$^2$ of Antidiscoloration Agent AO-3, 3 mg/dm$^2$ in silver equivalent of a red-sensitive silver chlorobromide emulsion (containing 20 mole % silver chloride and 80 mole % silver bromide) and 14 mg/dm$^2$ of gelatin.

Layer 6: Intermediate layer

Containing 4 mg/dm$^2$ of Ultraviolet Absorbing Agent UV-5, 2 mg/dm$^2$ of DBP and 6 mg/dm$^2$ of gelatin.

Layer 7: Protective layer

Containing 9 mg/dm$^2$ of gelatin.

The compounds that were used in preparing the sample:

DBP: Butyl phthalate

HQ-1

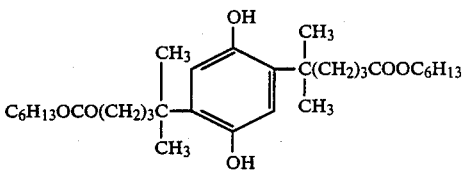

HQ-2

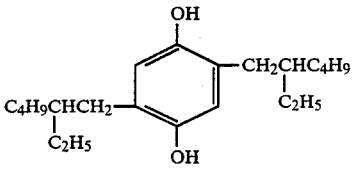

The thus prepared sample was regarded as Sample 1.

Subsequently, Samples 2 through 9 were prepared in the same manner as in Sample 1 except that the high-boiling organic solvent of Layers 5 and 6 was replaced by those as shown in Table 1.

These obtained samples each was exposed through an optical wedge to a red light by using a Sensitometer S-7 (manufactured by Konishiroku Photo Industry Co., Ltd.) and then processed in the following procedure:

| Processing Steps | Temperature | Time |
|---|---|---|
| Color developing | 32.8° C. | 3 min. 30 sec. |
| Bleach-fix | 32.8° C. | 1 min. 30 sec. |
| Washing | 32.8° C. | 3 min. 30 sec. |

Color Developer Solution

| | |
|---|---|
| N-ethyl-N-β-methansulfonamidoethyl-3-methyl-4-aminoaniline sulfate | 4.0 g |
| Hydroxylamine sulfate | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 ml |
| Polyethylene glycol (average polymerization degree: 400) | 3.0 ml |
| Water to make 1 liter, and use sodium hydroxide to adjust the pH to 10.0. | |

Bleach-Fix Bath

-continued

| | |
|---|---|
| Iron-sodium ethylenediaminetetraacetate | 60.0 g |
| Sodium thiosulfate | 100.0 g |
| Sodium hydrogensulfite | 20.0 g |
| Sodium metabisulfite | 5.0 g |
| Water to make 1 liter, and use sulfuric acid to adjust the pH to 7.0. | |

After the processing, each sample was evaluated with respect to its color formability, dye image's resistance to light and surface gloss deterioration degree in the following procedure:

Color Formability

The maximum color reflection density was measured by using an Optical Densitometer PDA-65 (manufactured by Konishiroku Photo Industry Co., Ltd.)

Dye Image's Resistance to Light

The dye image formed on each sample, placed on a glass-covered outdoor exposure stand, was exposed to the sunlight over a period of 40 days, and after that, was measured with respect to its discoloration rate:

$$\text{Discoloration rate} = \frac{D_0 - D}{D_0} \times 100\ (\%)$$

wherein $D_0$ represents the initial density (1.0), and D represents the density after the exposure).

Gloss Deterioration Degree

Each sample was allowed to stand for a period of 7 days under an atmospheric condition of 85° C./60% RH, and then its surface glossiness (5) was measured under a condition of a light incident angle of 60° by using a glossmeter (manufactured by Tokyo Denshoku Co., Ltd.).

The respective results are given in Table 1.

TABLE 1

| Sample No. | * High-boiling org. solvent | Cyan image maximum density | Cyan image discoloration rate (%) | Glossiness after aging (%) |
|---|---|---|---|---|
| 1 (comparative) | DBP | 2.21 | 18 | 85 |
| 2 (comparative) | DOA | 2.22 | 17 | 83 |
| 3 (comparative) | Comparative-1 | 2.08 | 25 | 87 |
| 4 (invention) | I-1 | 2.31 | 13 | 92 |
| 5 (invention) | I-5 | 2.29 | 12 | 91 |
| 6 (invention) | I-8 | 2.32 | 12 | 92 |
| 7 (invention) | I-25 | 2.33 | 13 | 93 |
| 8 (invention) | II-1 | 2.28 | 12 | 91 |
| 9 (invention) | II-4 | 2.31 | 12 | 92 |

*DBP: Dibutyl phthalate
DOA: Dioctyl azelate
Comparative-1: Methyl acrylate-acrylic acid (95:5) copolymer As is apparent from Table 1, the samples which use the high-boiling organic solvents of this invention show satisfactory color formability, improved dye image's light resistance, and almost no deterioration of the surface gloss after aging, so that the color image's clearness has remained intact even after the aging.

EXAMPLE 2

Eleven different samples, Samples 10 through 20, were prepared in the same manner as in Sample 1 of Example 1 except that the silver halide emulsion in Example 1 was replaced by a silver chlorobromide emulsion containing 99.5 mole % silver chloride, the magenta coupler was replaced by Magenta Coupler M-3, the cyan coupler was replaced by Cyan Couplers C-3 and C-4, and the high-boiling organic solvents in Layer 3 through Layer 6 were varied as shown in Table 2.

Each of Samples 10 through 20 was exposed through an optical wedge to white light in usual manner, and then processed in the following procedure:

| Processing Steps | Temperature | Time |
|---|---|---|
| Color developing | 34.7 ± 0.3° C. | 50 seconds |
| Bleach-fix | 34.7 ± 0.5° C. | 50 seconds |
| Stabilizing | 30–34° C. | 90 seconds |
| Drying | 60–80° C. | 60 seconds |

| Color Developer Solution | |
|---|---|
| Ethylene glycol | 10 ml |
| N,N-diethylhydroxylamine | 10 ml |
| Potassium chloride | 2 g |
| N-ethyl-N-β-methansulfonamidoethyl-3-methyl-4-aminoaniline sulfate | 5 g |
| Sodium tetrapolyphosphate | 2 g |
| Potassium carbonate | 30 g |
| Brightening agent (4,4'-diaminostilben-disulfonic acid derivative) | 1 g |
| Water to make 1 liter, and adjust the pH to 10.08. | |
| **Bleach-Fix Bath** | |
| Ferric-ammonium ethylenediaminetetraacetate, dihydrated | 60 g |
| Ethylenediaminetetraacetic acid | 3 g |
| Ammonium thiosulfate (aqueous 70% solution) | 100 ml |
| Ammonium sulfite (aqueous 40% solution) | 27.5 ml |
| Water to make 1 liter, and use potassium carbonate or glacial acetic acid to adjust the pH to 7.1. | |
| **Stabilizer Bath** | |
| 5-Chloro-2-methyl-4-isothiazolin-3-one | 1 g |
| 1-Hydroxyethylidene-1,1-diphosphonic acid | 2 g |
| Water to make 1 liter, and use sulfuric acid or potassium hydroxide to adjust the pH to 7.0. | |

After the processing, each sample was evaluated with respect to its color formability, light resistance, and surface gloss deterioration degree in the same manner as in Example 1. The results are given in Table 2.

TABLE 2

| Sample No. | *High-boiling org. solvent | Color formability(D max) Magenta | Color formability(D max) Cyan | Light resistance (discolored rate) Magenta | Light resistance (discolored rate) Cyan | Glossiness after aging (%) |
|---|---|---|---|---|---|---|
| 10 (comp.) | DBP | 2.21 | 2.20 | 23% | 18% | 85 |
| 11 (comp.) | DOA | 2.20 | 2.22 | 24 | 18 | 83 |
| 12 (comp.) | Comparative-1 | 2.01 | 2.05 | 35 | 26 | 87 |
| 13 (inv.) | I-1 | 2.33 | 2.33 | 15 | 12 | 94 |
| 14 (inv.) | I-5 | 2.34 | 2.31 | 14 | 11 | 93 |
| 15 (inv.) | I-8 | 2.33 | 2.33 | 14 | 11 | 94 |
| 16 (inv.) | I-14 | 2.29 | 2.29 | 17 | 14 | 93 |
| 17 (inv.) | I-24 | 2.30 | 2.28 | 17 | 14 | 94 |
| 18 (inv.) | II-2 | 2.35 | 2.33 | 14 | 11 | 94 |
| 19 (inv.) | II-4 | 2.34 | 2.34 | 14 | 11 | 93 |
| 20 (inv.) | II-5 | 2.30 | 2.25 | 16 | 14 | 93 |

Also from the results given in Table 2, it is understood that the samples of this invention are satisfactory in the color formability as well as in the dye image's light resistance, and little deteriorated in the surface gloss after aging.

EXAMPLE 3

On a subbed cellulose acetate film support were coated the following compositions-having layers in order from the support side, whereby Sample 21 was prepared. In this example, the amount of silver halide and of colloidal silver is shown in metallic silver equivalent.

Layer 1: Antihalation layer

Containing 0.2 g/m² of black colloidal silver and 1.7 g/m² of gelatin. Thickness: 075 μm.

Layer 2: Intermediate layer

Containing 1.0 g/m² of gelatin. Thickness: 0.75 μm.

Layer 3: Red-sensitive low-speed silver halide emulsion layer

Containing 1.6 g/m² of a core/shell-type red-sensitive low-speed silver iodobromide emulsion containing average 5 mole % silver iodide, with grains comprised of 10 mole % core and 2 mole % shell and having an average grain size of 0.5 μm, 1.7 g/m² of gelatin, 0.075 mole per mole of silver of the following Coupler C-12. 0.005 mole per mole of silver of Coupler CC-1, and 0.004 mole per mole of silver of the following DIR Compound D-1. Thickness: 2.75 μm.

Layer 4: Red-sensitive high-speed silver halide emulsion layer

Containing 1.1 g/m² of a red-sensitive high-speed silver iodobromide emulsion containing 5.5 mole % silver iodide, having an average grain size of 0.8μm, 1.0 g/m² of gelatin, 0.004 mole per mole of silver of Coupler C-12, 0.013 mole per mole of silver of the following Coupler C-13, 0.003 mole per mole of silver of Coupler CC-1, and 0.002 mole per mole of silver of DIR Compound D-1. Thickness: 1.2 μm.

Layer 5: Intermediate layer

Containing 0.6 g/m² of gelatin. Thickness: 0.45 μm.

Layer 6: Green-sensitive low-speed silver halide emulsion layer

Containing 1.3 g/m² of a core/shell-type green-sensitive low-speed silver iodobromide emulsion containing average 5 mole % silver iodide, with grains comprised of 10 mole % core and 2 mole % shell and having an average grain size of 0.5 μm, 1.6 g/m² of gelatin, 0.055 mole per mole of silver of Exemplified Coupler M-1, 0.014 mole per mole of silver of Coupler CM-1, and 0.004 mole per mole of silver of the following DIR Compound D-2. Thickness: 2.7 μm.

Layer 7: Green-sensitive high-speed silver halide emulsion layer

Containing 1.0 g/m² of a green-sensitive high-speed silver iodobromide emulsion containing 5.5 mole % silver iodide, having an average grain size of 0.8 μm, 0.8 g/m² of gelatin, 0.016 mole per mole of silver of Coupler M-1, 0.005 mole per mole of silver of Coupler CM-1, and 0.002 mole per mole of silver of DIR Compound D-2. Thickness: 1.3 μm.

Layer 8: Intermediate layer

Containing 0.6 g/m². Thickness: 0.45 μm.

Layer 9: Yellow filter layer

Containing 0.1 g/m² of yellow colloidal silver, 0.7 g/m² of gelatin and 0.06 g/m² of Antistain Agent HQ-3 (HQ-3 is added in dispersed product form). Thickness: 0.6 μm.

Layer 10: Blue-sensitive low-speed silver halid emulsion layer

Containing 0.5 g/m² of a core/shell-type blude-sensitive low-speed silver iodobromide emulsion containing average 5 mole % silver iodide, with grains comprised of 10 mole % core and 2 mole % shell having an average grain size of 0.5 μm, 2.0 g/m² of gelatin, and 0.34 mole per mole of silver of the following Coupler Y-15. Thickness: 3.1 μm.

Layer 11: Blue-sensitive high-speed silver halide emulsion layer

Containing 0.5 g/m² of a blue-sensitive high-speed silver iodobromide emulsion containing 7 mole % silver iodide, having an average grain size of 0.8 μm, 1.2 g/m$^2$ of gelatin and 0.10 mole per mole of silver of the following Coupler Y-15. Thickness: 1.4 μm.

Layer 12: Protective layer

Containing 2.0 g/m$^2$ of gelatin. Thickness: 1.5 μm.

In Sample 21 (comparative), dibutyl phthalate was used as the high-boiling organic solvent for each layer.

Also, in quite the same manner as in Sample 21, Sample 22 was prepared except that High-Boiling Organic Solvent I-8 of the invention was used in place of the dibutyl phthalate that was used in the Layers 3, 4, 6, 7 and 9 of Sample 21.

The additives that were used in preparing Samples 21 and 22 are as follows:

HQ-3

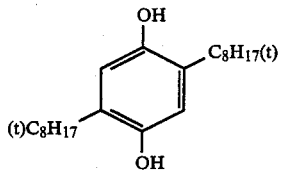

Coupler C-12

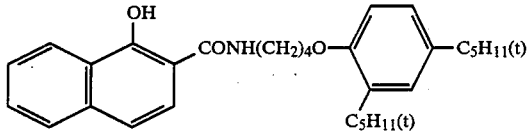

Coupler C-13

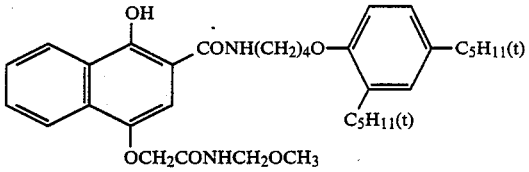

Coupler CC-1

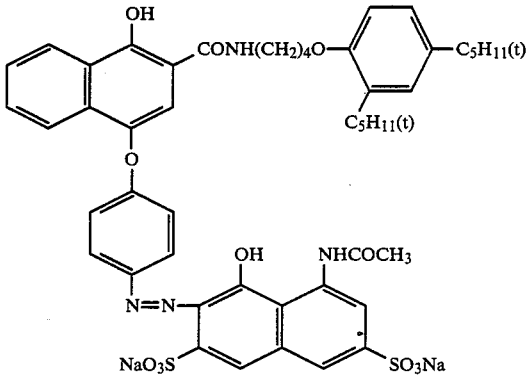

Coupler CM-1

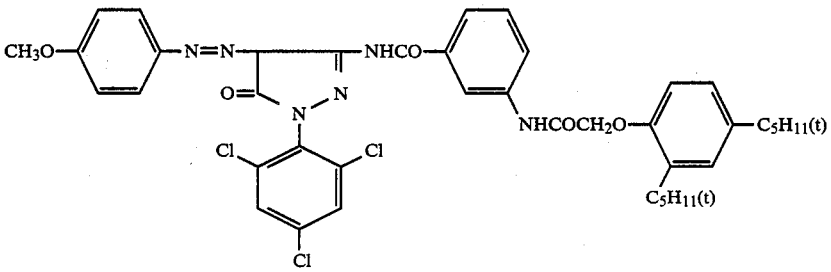

Coupler Y-15

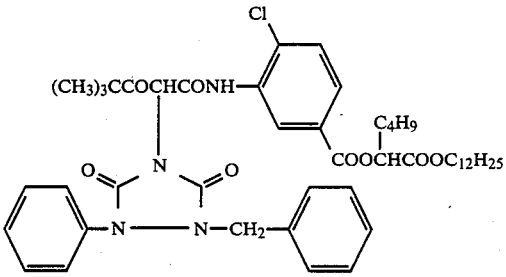

-continued

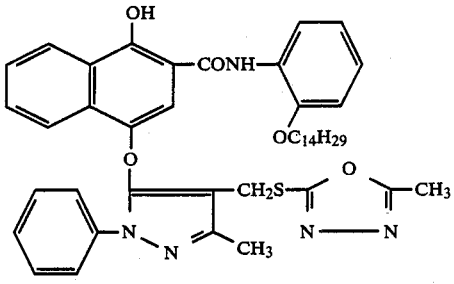

DIR Compound D-1

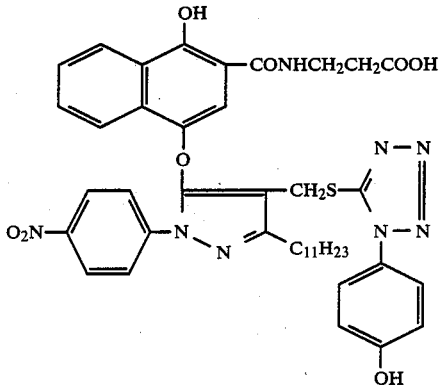

DIR Compound D-2

A 3.5 cm×14 cm-size test piece each of Samples 21 and 22 was exposed through a transparent square-wave chart in close contact therewith to white light, and then each exposed test piece was processed in the following procedure steps, whereby dye image-bearing samples were obtained.

| Processing Steps (at 38° C.) | Time |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |

The compositions of the processing solutions that were used in the respective processes are as follows:

| | |
|---|---|
| Color Developer Solution | |
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter, and adjust the pH to 10.0. | |
| Bleaching Bath | |
| Iron-ammonium ethylenediaminetetraacetate | 100.0 g |
| Diammonium ethylenediaminetetraacetate | 10.0 g |
| Ammonium Bromide | 150.0 g |
| Glacial acetic acid | 10.0 g |
| Water to make 1 liter, and adjust the pH to 6.0. | |
| Fixing Bath | |
| Ammonium thiosulfate (aqueous 50% solution) | 162.0 ml |
| Anhydrous sodium sulfite | 12.4 ml |
| Water to make 1 liter, and adjust the pH to 6.5. | |
| Stabilizer Bath | |
| Formalin (aqueous 37% solution) | 5.0 ml |
| Koniducks (product of Konishiroku Photo Industry Co., Ltd.) | 7.5 ml |

-continued

| |
|---|
| Water to make 1 liter |

After the processing, each color-formed image was tested with respect to its color formability, light resistance and gloss deterioration degree in the same manner as in Example 2.

Sample 22 gave a color negative image satisfactory in the color formation, excellent in the light resistance and free from surface gloss deterioration as compared to Sample 21.

EXAMPLE 4

Fifty grams of Exemplified Magenta Coupler M-10 were dissolved into a solvent mixture of 80 ml of a high-boiling organic solvent dioctyl phthalate and 200 ml of ethyl acetate, and this solution was added to an aqueous 5% gelatin solution containing a dispersing assistant sodium dodecylbenzenesulfonate and dispersed by using a homogenizer. The dispersed liquid, after making its whole quantity 1,500 ml, was kept warm at 35° C. The dispersed liquid was added to 1000 ml of an aqueous 3% gelatin solution, and to this were further added 400 g of a green-sensitive silver chlorobromide emulsion (containing 80 mole % silver bromide, amount of silver: 30 g), whereby a coating liquid was prepared. This liquid was kept warm at 35° C.

On a polyethylene-coated paper support was coated the above coating liquid so as to form a layer having a thickness of 30 μm, and further on this emulsion layer was coated a coating liquid containing gelatin, coating aid and hardening agent to form a protective layer. This sample was regarded as Sample 23.

Subsequently, Samples 24 through 41 were prepared in the same manner as in Sample 23 except that the coupler and the high-boiling organic solvent of Sample 23 were varied as shown in Table 3.

Each of the samples thus obtained was exposed through an optical wedge to a green light by using a Sensitometer KS-7 (manufactured by Konishiroku Photo Industry Co., Ltd.), and then processed in the following procedure:

| Processing Steps | Temperature | Time |
|---|---|---|
| Color developing | 32.8° C. | 3 min. 30 sec. |
| Bleach-fix | 32.8° C. | 1 min. 30 sec. |
| Washing | 32.8° C. | 3 min. 30 sec. |

Color Developer Solution

| | |
|---|---|
| N-ethyl-N-β-methansulfonamidoethyl-3-methyl-4-aminoaniline sulfate | 4.0 g |
| Hydroxylamine sulfate | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 ml |
| Polyethylene glycol (average polymerization degree: 400) | 3.0 ml |
| Water to make 1 liter, and use sodium hydroxide to adjust the pH to 10.0. | |

Bleach-Fix Bath

| | |
|---|---|
| Iron-sodium ethylenediaminetetraacetate | 60.0 g |
| Sodium thiosulfate | 100.0 g |
| Sodium hydrogensulfite | 20.0 g |
| Sodium metabisulfite | 5.0 g |
| Water to make 1 liter, and use sulfuric acid to adjust the pH to 7.0. | |

After the processing, each of the obtained magenta color-formed samples was measured with respect to its spectral absorption characteristic (secondary absorption at 430 nm, shifting-to-shorter-wavelength degree) and gradation (gamma value at a density of 0.8 to 1.8).

Spectral Absorption Characteristic test:

The spectral reflection spectrum of each magenta color-formed sample was measured by using a Color Analizer 607 (manufactured by Hitachi, Ltd.), wherein the measurement was made with each sample's maximum density at the visible-ray region's absorption spectrum standardized to 1.0.

Subsequently, the wavelength at which the visible-ray region (magenta)'s density of each sample is 0.5 (on the longer wavelength side of the maximum absorption wavelength region, hereinafter expressed as $\lambda_{0.5}$) was read to calculate changes in the $\lambda_{0.5}$ ($\Delta\lambda_{0.5}$) of each sample relative to the $\lambda_{0.5}$ of the sample in which dibutyl phthalate (DBP) was used as a high-boiling organic solvent. The value thus calculated was taken for a standard of color tone's shift to the shorter wavelength side, and thus regarded as the shifting-to-shorter-wavelength degree.

Also, the absorbance at 430 nm was read, and this reading was taken for a standard of the undesired absorption in the yellow region, and regarded as the secondary absorption.

These results are given collectively in Table 3.

TABLE 3

| Sample No. | Magenta coupler | High-boiling org. solvent | Secondary absorption | S.T.S.W. deg. $\Delta\lambda_{0.5}$(nm)*** | Gradation |
|---|---|---|---|---|---|
| 23 (Comp.) | M-10 | DBP** | 0.195 | 0 | 3.59 |
| 24 (Comp.) | " | DELA** | 0.193 | −4 | 3.03 |
| 25 (Comp.) | " | TOP** | 0.191 | −4 | 3.11 |
| 26 (Comp.) | " | DOA** | 0.195 | −1 | 3.56 |
| 27 (Inv.) | " | I-1 | 0.193 | −5 | 3.64 |
| 28 (Inv.) | " | I-5 | 0.194 | −5 | 3.63 |
| 29 (Inv.) | " | I-8 | 0.193 | −4 | 3.60 |
| 30 (Inv.) | " | I-25 | 0.194 | −5 | 3.59 |
| 31 (Comp.) | M-24 | DBP | 0.190 | 0 | 3.59 |
| 32 (Comp.) | " | DELA | 0.190 | −5 | 3.60 |
| 33 (Comp.) | " | DOA | 0.190 | −1 | 3.60 |
| 34 (Inv.) | " | I-1 | 0.190 | −5 | 3.69 |
| 35 (Inv.) | " | I-5 | 0.198 | −5 | 3.61 |
| 36 (Inv.) | " | I-8 | 0.193 | −5 | 3.60 |
| 37 (Inv.) | " | I-25 | 0.199 | −4 | 3.62 |
| 38 (Inv.) | " | II-2 | 0.194 | −5 | 3.62 |
| 39 (Inv.) | " | II-4 | 0.198 | −5 | 3.64 |
| 40 (Comp.) | Comparative-M* | DBP | 0.406 | 0 | 3.55 |
| 41 (Inv.) | " | I-1 | 0.406 | 0 | 3.48 |

Note:
***S.T.S.W. deg. stands for shifting-to-shorter-wavelength degree.
*Comparative Magenta Coupler M

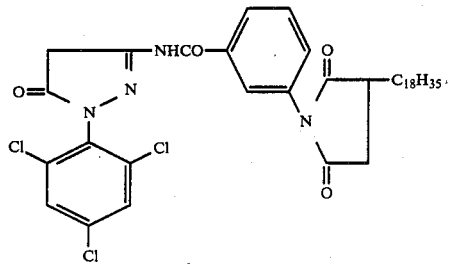

**DBP: Dibutyl phthalate
DELA: Diethyl-laurylamide
TOP: Trioctyl phosphate
DOA: Dioctyl adipate As is apparent from Table 3, in the samples for this invention, the color tone of each of their color-formed images is shifted to the shorter-wavelength side, and each image has a broader gradation and a small secondary absorption, so that a clear color image can be obtained, whereas in the comparative samples in which dibutyl phthalate was used, because of having no shifting-to-shorter-wavelength effect, bluishness-dominant magenta images are obtained showing no true color reproduction.

EXAMPLE 5

On a corona-discharge-treated polyethylene-coated paper support were coated the following layers in order from the support side, whereby a color light-sensitive material was prepared.

Layer 1: Blue-sensitive elulsion layer

Containing 8 mg/dm$^2$ of Yellow Coupler Y-2, 3 mg/dm$^2$ in silver equivalent of a blue-sensitive silver chlorobromide emulsion (containing 20 mole % silver chloride and 80 mole % silver bromide), 3 mg/dm$^2$ of a high-boiling organic solvent (DNP), 4 mg/dm$^2$ of Antidiscoloration agent AO-27 and 16 mg/dm$^2$ of gelatin.

Layer 2: Intermediate layer

Containing 0.45 mg/dm$^2$ of Hydroquinone Derivative HQ-1 and 4 mg/dm$^2$ of gelatin.

Layer 3: Green-sensitive emulsion layer

Containing 4 mg/dm$^2$ of Magenta Coupler M-10, 2 mg/dm$^2$ in silver equivalent of a green-sensitive silver chlorobromide emulsion (containing 20 mole % silver chloride and 80 mole % silver bromide), 4 mg/dm$^2$ of a high-boiling organic solvent (DOP), Antidiscoloration Agent AO-6 and 16 mg/dm$^2$ of gelatin.

Layer 4: Intermediate layer

Containing 3 mg/dm$^2$ of Ultraviolet Absorpting Agent UV-1 and 3 mg/dm$^2$ of UV-2, 4 mg/dm$^2$ of DNP, 0.45 mg/dm$^2$ of Hydroquinone Derivative HQ-2 and 14 mg/dm$^2$ of gelatin.

Layer 5: Red-sensitive emulsion layer

Containing 2 mg/dm$^2$ of Cyan Coupler C-5 and 2 mg/dm$^2$ of C-7, 4 mg/dm$^2$ of DOP, 2 mg/dm$^2$ of Antidiscoloration Agent AO-33, 3 mg/dm$^2$ in silver equivalent of a red-sensitive silver chlorobromide emulsion (containing 20 mole % silver chloride and 80 mole % silver bromide) and 14 mg/dm$^2$ of gelatin.

Layer 6: Intermediate layer

Containing 4 mg/dm$^2$ of Ultraviolet Absorbing Agent UV-3, 0.2 mg/dm$^2$ of HQ-1, 2 mg/dm$^2$ of DNP and 6 mg/dm$^2$ of gelatin.

Layer 7: Protective layer

Containing 9 mg/dm$^2$ of gelatin.

Compounds that were used in preparing the sample:

DNP: Dinonyl phthalate

DOP: Dioctyl phthalate

HQ-1

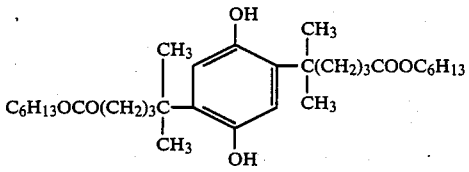

HQ-2

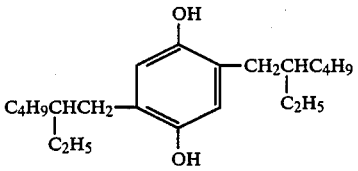

-continued

UV-1

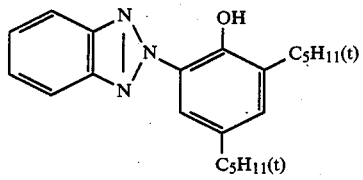

UV-2

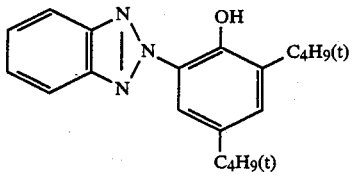

UV-3

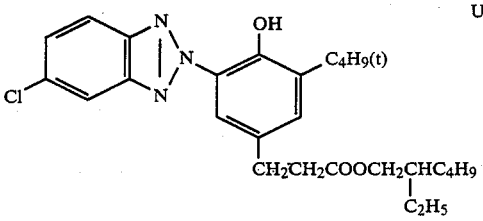

AO-33

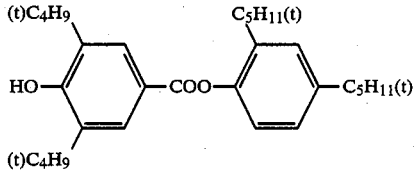

The obtained light-sensitive material was regarded as Sample 42.

Also, Samples 43 through 53 were prepared in the same manner as in Sample 42 except that the combination of the coupler with the high-boiling organic solvent in Sample 42 was varied as shown in Table 4.

Each of these samples was exposed, processed, and evaluated with respect to its spectral absorption characteristics and gradation in the same manner as in Example 4.

In addition, these processed samples each was subjected to the following light resistance test to thereby evaluate its resistance to light.

Light Resistance Test:

The dye image formed on each sample, placed on a glass-covered outdoor exposure stand, was exposed to the sunlight over a period of 40 days, and after that, was measured with respect to its discoloration rate of the initial density ($D_0$=1.0):

$$\text{Discoloration rate} = \frac{D_0 - D}{D_0} \times 100\ (\%)$$

wherein D=density after discoloration.

The results are given also in Table 4.

TABLE 4

| Sample No. | Magenta coupler | High-boiling org. solvent | Secondary absorption | S.T.S.W. deg.* $\Delta\lambda_{0.5}$ (nm) | Gradation | Discolored rate (%) |
|---|---|---|---|---|---|---|
| 42 (Comp.) | M-26 | DBP | 0.205 | 0 | 3.49 | 34 |
| 43 (Comp.) | " | DELA | 0.202 | −4 | 3.01 | 41 |
| 44 (Inv.) | " | I-1 | 0.202 | −4 | 3.50 | 27 |
| 45 (Inv.) | " | I-5 | 0.202 | −5 | 3.50 | 27 |
| 46 (Inv.) | " | I-8 | 0.202 | −5 | 3.49 | 28 |
| 47 (Inv.) | " | I-14 | 0.201 | −4 | 3.45 | 29 |
| 48 (Inv.) | " | I-24 | 0.201 | −4 | 3.44 | 29 |
| 49 (Inv.) | " | II-2 | 0.201 | −5 | 3.50 | 27 |
| 50 (Inv.) | " | II-4 | 0.204 | −5 | 3.51 | 26 |
| 51 (Inv.) | " | II-5 | 0.201 | −4 | 3.45 | 29 |
| 52 (Comp.) | Comparative-M | DBP | 0.361 | 0 | 3.52 | 32 |
| 53 (Inv.) | Comparative-M | II-2 | 0.363 | 0 | 3.36 | 30 |

Note: *S.T.S.W. deg. stands for shifting-to-shorter-wavelength degree.

As is apparent from Table 4, even in the multicolor light-sensitive materials, each of the samples of this invention gives a clear image of which the magenta image's color tone is largely shifted to the shorter wavelength side and which has an adequate gradation. And despite the large shifting-to-shorter-wavelength effect, each sample of this invention shows little deterioration of its light resistance.

EXAMPLE 6

Samples 54 through 59 were prepared in the same manner as in Sample 42 of Example 5 except that a silver chlorobromide emulsion containing 99 mole % silver chloride was used in place of the silver halide emulsion of Example 5, Magenta Coupler M-46 in place of the magenta coupler, Cyan Couplers C-6 and C-11 in place of the cyan coupler, and the high-boiling solvent and antidiscoloration agent in Layer 3 were varied as shown in Table 5.

The prepared Samples 54 through 59 each was exposed through an optical wedge to white light in usual manner, and then processed in the following procedure:

| Processing Steps | Temperature | Time |
|---|---|---|
| Color developing | 34.7 ± 0.3° C. | 50 seconds |
| Bleach-Fix | 34.7 ± 0.5° C. | 50 seconds |
| Stabilizing | 30–34° C. | 90 seconds |
| Drying | 60–80° C. | 60 seconds |

Color Developer Solution

| | |
|---|---|
| Ethylene glycol | 10 ml |
| N,N-diethylhydroxylamine | 10 ml |
| Potassium chloride | 2 g |
| N-ethyl-N-β-methansulfonamidoethyl-3-methyl-4-aminoaniline sulfate | 5 g |
| Sodium tetrapolyphosphate | 2 g |
| Potassium carbonate | 30 g |
| Brightening agent (4,4'-diaminostilbene-disulfonic acid derivative) | 1 g |
| Water to make 1 liter, and adjust the pH to 10.08. | |

Bleach-Fix Bath

-continued

| | |
|---|---|
| Ferric-ammonium ethylenediaminetetraacetate, dihydrated | 60 g |
| Ethylenediaminetetraacetic acid | 3 g |
| Ammonium thiosulfate (aqueous 70% solution) | 100 ml |
| Ammonium sulfite (aqueous 40% solution) | 27.5 ml |
| Water to make 1 liter, and use potassium carbonate or glacial acetic acid to adjust the pH to 7.1. | |

Stabilizing Bath

| | |
|---|---|
| 5-Chloro-2-methyl-4-isothiazolin-3-one | 1 g |
| 1-Hydroxyethylidene-1,1-diphosphonic acid | 2 g |
| Water to make 1 liter, and use sulfuric acid or potassium hydroxide to adjust the pH to 7.0. | |

After the processing, each sample was evaluated with respect to its spectral absorption characteristic (shifting-to-shorter-wavelength degree) and light resistance (discoloration rate) in the same manner as in Example 5.

The results are given in Table 5.

TABLE 5

| Sample No. | High-boiling org. solvent | Antidiscoloration agent* | S.T.S.W. deg. $\Delta\lambda_{0.5}$ (nm) | Discolored rate (%) |
|---|---|---|---|---|
| 54 (Comparative) | DBP | AO-6 | 0 | 45 |
| 55 (Comparative) | DELA | " | −4 | 62 |
| 56 (Invention) | II-1 | " | −4 | 39 |
| 57 (Invention) | " | AO-6 + AO-12 | −4 | 23 |
| 58 (Invention) | " | AO-6 + AO-21 | −5 | 24 |
| 59 (Invention) | " | AO-6 + AO-28 | −6 | 24 |

*One mole (0.5 mole each when used in combination) per mole of coupler.

As is apparent from Table 5, each of the samples of this invention gives a clear image which has little undesired absorption on the longer wavelength side and which is free of bluishness. In addition, the high-boiling organic solvent of this invention does not deteriorate the light resistance of the color image.

EXAMPLE 7

On a subbed cellulose acetate film support were coated the following layers in order from the support side, whereby Sample 60 was prepared. In this example, the amount of silver halide and of colloidal silver is shown in metallic silver equivalent.

Layer 1: Antihalation layer

Containing 0.2 g/m$^2$ of black colloidal silver and 1.7 g/m$^2$ of gelatin. Thickness: 1.25 μm.

Layer 2: Intermediate layer

Containing 1.0 g/m$^2$ of gelatin. Thickness: 0.75 μm.

Layer 3: Red-sensitive low-speed silver halide emulsion layer

Containing 1.6 g/m² of a red-sensitive low-speed silver iodobromide emulsion containing average 5 mole % silver iodide, with grains comprised of 10 mole % core and 2 mole % shell and having an average grain size of 0.5 μm, 1.7 g/m² of gelatin, 0.075 mole per mole of silver of the following Coupler C-13, 0.005 mole per mole of silver of Coupler CC-1, and 0.004 mole per mole of silver of the following DIR Compound D-1. Thickness: 2.75 μm.

Layer 4: Red-sensitive high-speed silver halide emulsion layer

Containing 1.1 g/m² of a red-sensitive high-speed silver iodobromide emulsion containing 5.5 mole % silver iodide and having an average grain size of 0.8 μm, 1.0 g/m² of gelatin, 0.004 mole per mole of silver of the following Coupler C-13, 0.013 mole per mole of silver of Coupler C-14, 0.003 mole per mole of silver of Coupler CC-1 and 0.002 mole per mole of silver of DIR Compound D-1. Thickness: 1.2 μm.

Layer 5: Intermediate layer

Containing 0.6 g/m² of gelatin. Thickness: 0.45 μm.

Layer 6: Green-sensitive low-speed silver halide emulsion layer

Containing 1.3 g/m² of a green-sensitive low-speed silver iodobromide emulsion containing average 5 mole % silver iodide, with grains comprised of 10 mole % core and 2 mole % shell and having an average grain size of 0.5 μm, 1.6 g/m² of gelatin, 0.055 mole per mole of silver of Exemplified Couple M-1, 0.014 mole per mole of silver of Coupler CM-1, and 0.004 mole per mole of silver of the following DIR Compound D-2. Thickness: 2.7 μm.

Layer 7: Green-sensitive high-speed silver halide emulsion layer

Containing 1.0 g/m² of a green-sensitive high-speed silver iodobromide emulsion containing 5.5 mole % silver iodide and having an average grain size of 0.8 μm, 0.8 g/m² of gelatin, 0.016 mole per mole of silver of Coupler M-1, 0.005 mole per mole of silver of Coupler CM-1, and 0.002 mole per mole of silver of DIR Compound D-2. Thickness: 1.3 μm.

Layer 8: Intermediate layer

Containing 0.6 g/m² of gelatin. Thickness: 0.45 μm.

Layer 9: Yellow filter layer

Containing 0.1 g/m² of yellow colloidal silver, 0.7 g/m² of gelatin, and 0.06 g/m² of Antistain Agent HQ-3 (HQ-3 is added in dispersed product form). Thickness: 0.6 μm.

Layer 10: Blue-sensitive low-speed silver halide emulsion layer

Containing 0.5 g/m² of a blue-sensitive low-speed silver iodobromide emulsion containing average 5 mole % silver iodide, with grains comprised of 10 mole % core and 2 mole % shell and having an average grain size of 0.5 μm, 2.0 g/m² of gelatin, and 0.34 mole per mole of silver of Coupler Y-7. Thickness: 3.1 μm.

Layer 11: Blue-sensitive high-speed silver halide emulsion layer

Containing 0.5 g/m² of a blue-sensitive high-speed silver iodobromide emulsion containing 7 mole % silver iodide and having an average grain size of 0.8 μm, 1.2 g/m² of gelatin, and 0.10 mole per mole of silver of Coupler Y-7. Thickness: 1.4 μm.

Layer 12: Protective colloid layer

Containing 2.0 g/m² of gelatin. Thickness: 1.5 μm.

In Sample 60 (comparative), dibutyl phthalate was used as the high-boiling organic solvent for each layer. Also, Sample 61 was prepared in quite the same manner as in Sample 60 except that High-Boiling Organic Solvent I-1 of this invention was used in place of the dibutyl phthalate that was used in Layers 6 and 7 of Sample 60.

The compounds that were used in preparing Samples 60 and 61 are as follows:

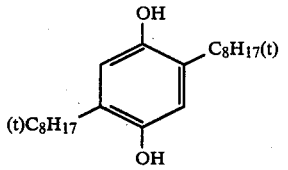

HQ-3

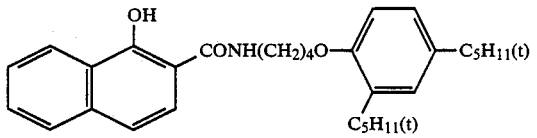

Coupler C-13

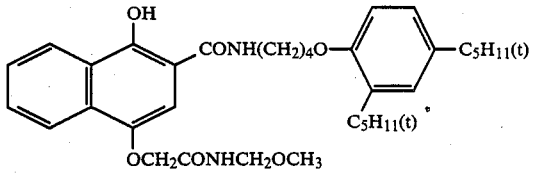

Coupler C-14

-continued

Coupler CC-1

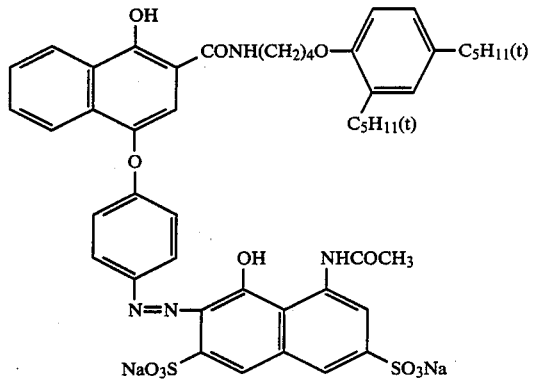

Coupler CM-1

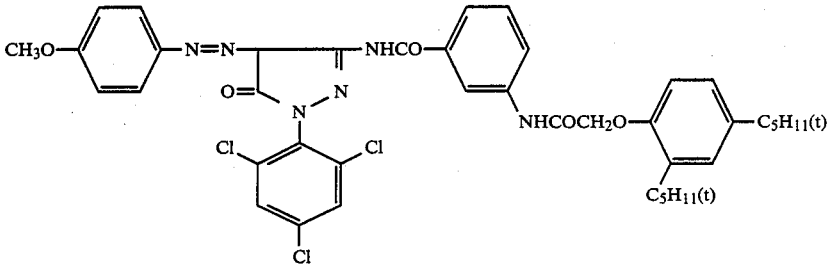

DIR Compound D-1

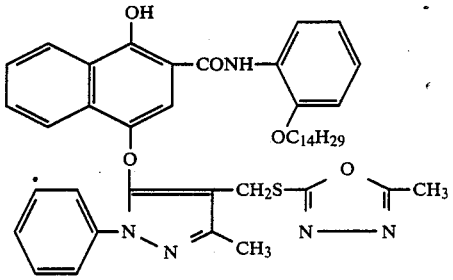

DIR Compound D-2

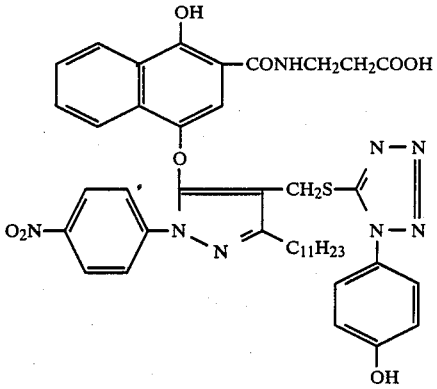

A 3.5 cm × 14 cm-size test piece of each of Samples 60 and 61 was exposed through a transparent square-wave chart in close contace therewith to white light, and then processed in the following procedure, whereby dye image-bearing samples were obtained.

| Processing Steps (at 38° C.) | Processing Time |
|---|---|
| Color developing | 3 min. 15 sec. |
| Bleaching | 6 min. 30 sec. |
| Washing | 3 min. 15 Sec. |
| Fixing | 6 min. 30 sec. |
| Washing | 3 min. 30 sec. |

-continued

| Processing Steps (at 38° C.) | Processing Time |
|---|---|
| Stabilizing | 1 min. 30 sec. |

The compositions of the processing solutions that were used in the above procedure are as follows:

| Color Developer Solution | |
|---|---|
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |

-continued

| | |
|---|---|
| Anhydrous ptassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter, and adjust the pH to 10.0. | |
| Bleaching Bath | |
| Iron-ammonium ethylenediaminetetraacetate | 100.0 g |
| Diammonium ethylenediaminetetraacetate | 10.0 g |
| Ammonium bromide | 150.0 g |
| Glacial acetic acid | 10.0 g |
| Water to make 1 liter, and adjust the pH to 6.0. | |
| Fixing Bath | |
| Ammonium thiosulfate (aqueous 50% solution) | 162.0 ml |
| Anhydrous sodium sulfite | 12.4 ml |
| Water to make 1 liter, and adjust the pH to 6.5. | |
| Stabilizer Bath | |
| Formalin (aqueous 37% solution) | 5.0 ml |
| Koniducks (product of Konishiroku Photo Industry Co., Ltd.) | 7.5 ml |
| Water to make 1 liter | |

The thus color-formed image of Sample 61 is a satisfactory gradation-having clear image with its magenta color tone well shifted to the shorter wavelength side as compared to Sample 60.

What is claimed is:

1. A silver halide light-sensitive photographic material which comprises a support and, provided thereon, photographic component layers including at least one silver halide emulsion layer, wherein at least one of said photographic component layers contains a compound of Formula [I] and/or Formula [II]:

$$R_1OOC—R_2—COO\text{-}(R_3—OOC—R_2—COO)_n\text{-}R_4 \quad [I],$$

$$R_5O—R_6\text{-}(OOC—R_7—COO—R_6)_n\text{-}OR_8 \quad [II]$$

wherein $R_1$ and $R_4$ are independently selected from the group consisting of an alkyl group, and alkenyl group, a cycloalkyl group, an aryl group and a heterocyclic group; $R_2$, $R_3$, $R_6$ and $R_7$ are divalent groups independently selected from the group consisting of an alkylene group, an alkenylene group, a cycloalkylene group and a group of any combination of these groups; $R_5$ and $R_8$ each is either an acyl group or a phosphonyl group; and n is an integer of from 1 to 20.

2. The silver halide light-sensitive photographic material of claim 1, wherein n is an integer of from 1 to 10.

3. The silver halide light-sensitive photographic material of claim 2, wherein n is an integer of 2 to 7.

4. The silver halide light-sensitive photographic material of claim 1, wherein said compound is one represented by Formula [I*a*] or Formula [II*a*]:

$$R_1OOC(CH_2)n'COO\text{-}(R_3'—OOC(CH_2)n'COO)_n\text{-}R_4 \quad [Ia],$$

$$R_5'COO—R_6'\text{-}(OOC(CH_2)n'COO—R_6')_n\text{-}OOCR_8' \quad [IIa]$$

wherein $R_1$ and $R_4$ are independently selected from the group consisting of an alkyl group, an alkenyl group, a cycloalkyl group, an aryl group and a heterocyclic group; $R_3'$ and $R_6'$ each is independently a straight-chain or branched-chain alkylene group having 2 to 8 carbon atoms; $R_5'$ and $R_8'$ each is either an alkyl group or an aryl group; n' is an integer of from 2 to 10, and n'' is an integer of from 1 to 10.

5. The silver halide light-sensitive photographic material of claim 4, wherein $R_3'$ and $R_6'$ each is independently a straight-chain or branched-chain alkylene group having 3 to 4 carbon atoms, and n' is an integer of 4 to 8.

6. The silver halide light-sensitive photographic material of claim 4, wherein said compound is a compound represented by Formula [Ib] or [IIb]:

$$R_1OOC(CH_2)_{n'}COO\text{-}(CH(CH_2)_{n'''}OOC(CH_2)_{n'}COO)_{n''}\text{-}R_4, \quad [Ib]$$

$$R_5'COOCH(CH_2)_{n'''}\text{-}(OOC(CH_2)_{n'}COOCH(CH_2)_{n'''})_{n''}\text{-}OOCR_8' \quad [IIb]$$

wherein $R_1$ and $R_4$ are independently selected from the group consisting of an alkyl group, an alkenyl group, a cycloalkyl group, an aryl group and a heterocyclic group; $R_3'$ and $R_6'$ each is independently a straight-chain or branched-chain alkylene group having 2 to 8 carbon atoms; $R_5'$ and $R_8'$ each is either an alkyl group or an aryl group; n' is an integer of from 2 to 10, and n'' is an integer of from 1 to 10, and n''' is 1 or 2.

7. The silver halide light-sensitive photographic material of claim 6, wherein $R_1$, $R_4$, $R_5'$ and $R_8'$ each is independently a straight-chain or branched-chain alkyl group.

8. The silver halide light-sensitive photographic material of claim 1, wherein said silver halide emulsion layer contains a magenta dye-forming coupler represented by Formula [M-I]:

[M-I]

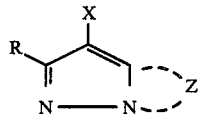

wherein Z represents a group of non-metal atoms necessary to complete a nitrogen-containing heterocyclic ring which may have a substituent; X represents a hydrogen atom or a substituent capable of being split off upon reaction with the oxidized product of a color developing agent; and R represents a hydrogen atom or a substituent.

9. The silver halide light-sensitive photographic material of claim 8, wherein said compound is contained in said silver halide emulsion layer.

10. The silver halide light-sensitive photographic material of claim 9, wherein the magenta dye-forming coupler of [M-I] is selected from those represented by Formulas [M-II], [M-III], [M-IV], [M-V], [M-VI] and [M-VII]:

[M-II]

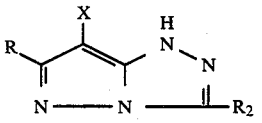

[M-III]

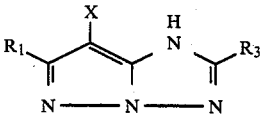

-continued

[M-IV]

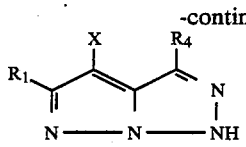

[M-V]

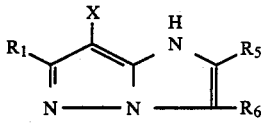

[M-VI]

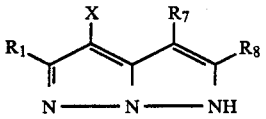

[M-VII]

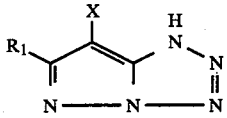

wherein $R_1$ through $R_8$ and X in Formulas [M-II], [M-III], [M-IV], [M-V], [M-VI] and [M-VII] have the same definitions as for the R and the X in [M-I], respectively.

11. The silver halide light-sensitive photographic material of claim 9, wherein the magenta dye-forming coupler of [M-I] is selected from those represented by Formula [M-VIII]:

[M-VIII]

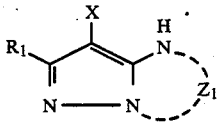

wherein $Z_1$ represents a group of non-metal atoms necessary to complete a nitrogen-containing heterocyclic ring which may have a substituent; X represents a hydrogen atom or a substituent capable of being split off upon reaction with the oxidized product of a color developing agent; and $R_1$ represents a hydrogen atom or a substituent.

12. The silver halide light-sensitive photographic material of claim 9, wherein the R in Formula [M-I] is a group represented by Formula [M-IX]:

[M-IX]

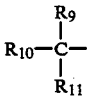

wherein $R_9$, $R_{10}$ and $R_{11}$ each represents either a hydrogen atom or a substituent.

13. The silver halide light-sensitive photographic material of claim 10, wherein the $R_1$ in Formula [M-II] through [M-VII] is a group represented by Formula [M-IX]:

[M-IX]

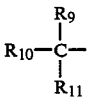

wherein $R_9$, $R_{10}$ and $R_{11}$ each represents either a hydrogen atom or a substituent.

14. The silver halide light-sensitive photographic material of claim 10, wherein the $R_2$ through $R_8$ in Formulas [M-II] through [M-VII] is a group represented by Formula [M-X]:

$$-R_{12}-SO_2-R_{13} \qquad \text{[M-X]}$$

wherein $R_{12}$ is an alkylene group, $R_{13}$ ios an alkyl group, a cycloalkyl group or an aryl group.

15. The silver halide light-sensitive photographic material of claim 11, wherein the $R_1$ in Formula [M-VIII] is a group represented by Formula [M-IX]:

[M-IX]

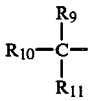

wherein $R_9$, $R_{10}$ and $R_{11}$ each independently represents a hydrogen atom or a substituent.

16. The silver halide light-sensitive photographic material of claim 9, wherein said silver halide emulsion layer contains an anti-discoloration agent.

17. The silver halide light-sensitive photographic material of claim 1, wherein said silver halide emulsion layer contains a yellow dye-forming coupler.

18. The silver halide light-sensitive photographic material of claim 9, wherein at least one of said photographic component layers is a second silver halide emulsion layer containing a yellow dye-forming coupler.

19. The silver halide light-sensitive photographic material of claim 1, wherein said silver halide emulsion layer contains a cyan dye-forming coupler.

20. The silver halide light-sensitive photographic material of claim 8, wherein at least one of said photographic component layers is a second layer silver halide emulsion layer containing a cyan dye-forming coupler.

21. The silver halide light-sensitive photographic material of claim 20, wherein said cyan dye-forming coupler is a compound represented by Formula [PC-I]:

[PC-I]

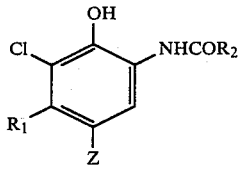

wherein $R_1$ is a straight-chain or branched-chain alkyl group having from 2 to 6 carbon atoms which may have a substituent, $R_2$ is an organic ballasting group having a sufficient size and/or shape to substantially prevent the cyan dye-forming coupler from migrating into other layer, and Z is a hydrogen atom or a substituent capable of being split off upon reaction with the oxidized product of a color developing agent.

22. The silver halidelight-sensitive photographic material of claim 21, wherein said ballasting group is one represented by the formula:

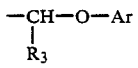

wherein $R_3$ is an alkyl group having 1 to 12 carbon atoms, and Ar is an aryl group which may have a substituent.

* * * * *

UNITED STATES PATENT AND TRADEMARK OFFICE

CERTIFICATE OF CORRECTION

PATENT NO. : 4,916,050

DATED : April 10, 1990

INVENTOR(S) : Toyoki Nishijima et al.

It is certified that error appears in the above-identified patent and that said Letters Patent is hereby corrected as shown below:

In the Abstract, Line 6, in Formula [II], change "$R_8$" to --$OR_8$--;

Claim 4, Column 71, Line 54, (in Formula [Ia]), change "($CII_2$)" (both occurrences) to --($CH_2$)--;

Claim 4, Column 71, Line 56, (in Formula IIa), change "($CII_2$) to --($CH_2$)--;

Claim 10, Column 72, Line 60, (in Formula [M-II]), change "R" to --$R_1$--;

Claim 14, Column 74, Line 6, change "ios" to --is--;

UNITED STATES PATENT AND TRADEMARK OFFICE

CERTIFICATE OF CORRECTION

PATENT NO. : 4,916,050

DATED : April 10, 1990

INVENTOR(S) : Toyoki Nishijima et al.

It is certified that error appears in the above-identified patent and that said Letters Patent is hereby corrected as shown below:

Claim 22, Column 74, Line 57, change "halidelight-sensitive" to --halide light-sensitive--;

Signed and Sealed this

Thirteenth Day of October, 1992

*Attest:*

DOUGLAS B. COMER

*Attesting Officer*

*Acting Commissioner of Patents and Trademarks*